US005840633A

United States Patent [19]

Kurihara et al.

[11] Patent Number: 5,840,633

[45] Date of Patent: Nov. 24, 1998

[54] NONWOVEN FABRIC AND METHOD OF MAKING THE SAME

[75] Inventors: Kazuhiko Kurihara, Itabashi-ku; Hiroshi Yazawa, Kunitachi; Toshikazu Ohishi, Kawaguchi; Yoichi Mazawa, Yono; Yuki Kuroiwa, Shiki; Shuichi Murakami, Itabashi-ku; Sadayuki Ishiyama, Setagaya-ku; Jun Yamada, Yokosuka, all of Japan

[73] Assignees: Polymer Processing Research Inst., Ltd.; Nippon Petrochemicals Company, Ltd., both of Tokyo, Japan

[21] Appl. No.: 682,535

[22] PCT Filed: Nov. 22, 1995

[86] PCT No.: PCT/JP95/02376

§ 371 Date: Sep. 17, 1996

§ 102(e) Date: Sep. 17, 1996

[87] PCT Pub. No.: WO96/17121

PCT Pub. Date: Jun. 6, 1996

[30] Foreign Application Priority Data

Nov. 25, 1994 [JP] Japan ..... 6-315470

[51] Int. Cl.[6] ..... D04H 3/04; D04H 3/00

[52] U.S. Cl. ..... 442/361; 442/353; 442/358; 442/362; 442/364; 442/381; 442/389; 156/85; 156/229

[58] Field of Search ..... 442/352, 353, 442/358, 361, 362, 364, 381, 389; 156/85, 229, 278

[56] References Cited

U.S. PATENT DOCUMENTS

| | | | |
|---|---|---|---|
| 4,657,804 | 4/1987 | Mays et al. | 442/381 X |
| 5,102,724 | 4/1992 | Okawahara et al. | 442/362 X |
| 5,424,115 | 6/1995 | Stokes | 442/361 X |
| 5,534,339 | 7/1996 | Stokes | 442/361 |

FOREIGN PATENT DOCUMENTS

| | | |
|---|---|---|
| 2-61156 | 3/1990 | Japan . |
| 2-182963 | 7/1990 | Japan . |
| 3-269154 | 11/1991 | Japan . |
| 4-24216 | 1/1992 | Japan . |
| 4-41762 | 2/1992 | Japan . |
| 4-316608 | 11/1992 | Japan . |

OTHER PUBLICATIONS

Jap Pat. Abst 5–230754.

Jap Pat. Abst 5–125645.

Jap Pat. Abst 2–182963.

*Primary Examiner*—Daniel Zirker

*Attorney, Agent, or Firm*—Scully, Scott, Murphy & Presser

[57] ABSTRACT

The invention provides a nonwoven fabric of stretched filaments of different kind polymers, having a strength equal to that of a woven fabric and features including an elongation, a uniformity, good feeling, a bulkiness and a thinness, characterized in that the nonwoven fabric is provided with stretched filament webs comprising long filaments formed out of a plural kinds of thermoplastic polymers of different properties, the long filaments as a whole being aligned in one direction, and a method for manufacturing the same. The invention provides also a nonwoven fabric of stretched filaments having a high strength as well as a high bulkiness and comprising different kind polymers which is provided with a first web layer of crimped filaments and a second web layer of substantially non-crimped, stretched long filaments, and a method for manufacturing the same.

18 Claims, 10 Drawing Sheets

NONWOVEN FABRIC AND METHOD OF MAKING THE SAME

TECHNICAL FIELD

The present invention relates to a nonwoven cloth of drawn or stretched filaments of different kind polymers, which is improved in various properties such as strength, elongation, adhesion and bulkiness; and comprises stretched filament webs each of which is prepared by stretching long filaments formed of a plural kind of thermoplastic polymers of different properties in one direction, and aligning the long filaments the thus stretched in one direction, and further the invention relates to a method of manufacturing the nonwoven cloth or fabric as mentioned above.

Furthermore, the present invention relates to a stretched nonwoven fabric which is excellent particularly in the strength and the bulkiness, and a method for producing the same. More particularly, the present invention relates to a nonwoven fabric having a high strength and a high bulkiness which is prepared by joining a stretched filament web in combination with a web having different shrink properties from that of the former web, and thereafter shrinking the thus joined webs without employing any complicated and expensive apparatus; as well as relates to a method for manufacturing such nonwoven fabric.

BACKGROUND ART

Most of the conventional nonwoven fabrics were random nonwoven fabrics, so that most of them were not strong enough and poor in dimensional stability. In order to improve the disadvantages involved in these conventional nonwoven fabrics, the present inventors have proposed several methods each for manufacturing a nonwoven fabric by stretching fiber webs and crosswise laminating them together (Japanese Patent Publication No. Hei 3-36948, Japanese Patent Laid-Open Publication No. Hei 2-269859, Japanese Patent Laid-Open Publication No. Hei 2-269860). The present invention is the one which has been accomplished by improving and developing further these inventions.

Heretofore, a variety of examples have been known that mixed spun filaments or conjugate spun filaments prepared by employing polymers of different kinds are applied to the manufacturing of a nonwoven fabric.

For instance, bulky conjugate filaments are disclosed in Japanese Patent Laid-Open Publication No. Hei 4-24216 (short fiber nonwoven fabric), Japanese Patent Laid-Open Publication No. Hei 2-182963 (spunbonded nonwoven fabric), and Japanese Patent Laid-Open Publication No. Hei 4-41762 (spunbonded nonwoven fabric); adherent conjugate filaments are disclosed in Japanese Patent Laid-Open Publication No. Hei 2-61156 (spunbonded nonwoven fabric) and Japanese Patent Laid-Open Publication No. Hei 4-316608 (spunbonded nonwoven fabric); mixed filaments are disclosed in Japanese Patent Laid-Open Publication No. Hei 3-269154 (spunbonded nonwoven fabric); and the water-jet processing of nonwoven fabric composed of conjugate filaments is disclosed in Japanese Patent Laid-Open Publication No. Hei 4-316608 (spunbonded nonwoven fabric).

The above described conventional nonwoven fabrics involve the ones in which conjugate filaments and polymer filaments of different kinds are used together. However, they are short fiber nonwoven fabrics which are made by cutting conjugate filaments and polymer filaments of different kinds, so that, although the bulkiness is satisfactory, the strength and dimensional stability are not good. Furthermore, there have been long filament nonwoven fabrics such as spunbonded nonwoven fabric or melt-blown nonwoven fabric in accordance with conjugate spinning. However, since these nonwoven fabrics are not stretched, the effect of shrinkage cannot be produced, so that their bulkiness is insufficient and strength as well as dimensional stability are not satisfactory.

More specifically, in these nonwoven fabrics according to the prior art, the balance among the bulkiness, the strength as a single filament, and the strength as the whole material of nonwoven fabric is insufficient, so that they cannot not have physical properties enough as the ones which can be employed in place of the woven fabrics. In addition to the above, when a basis weight is small (e.g., less than 20 g/m$^2$) in conventional nonwoven fabrics, the uniformity of the resulting nonwoven fabric is inferior in general, so that such nonwoven fabrics could not be used in a field where the comparable dimensional stability to that of woven fabric is required, because of the reason that conventional nonwoven fabrics have insufficient strength in addition to the inferior uniformity as described above.

Meanwhile, the crosswise laminated nonwoven fabrics disclosed in the above inventions of us is prepared by bonding fiber webs with emulsion adhesive or thermally embossing bonding operation, so that refined feeling and softness are sometimes insufficient as nonwoven fabrics.

In order to make better the above described various disadvantages involved in the conventional nonwoven fabrics, the present inventors proposed some inventions in which nonwoven fabrics are stretched and suitably laminated to produce a new kind of nonwoven fabrics (Japanese Patent Publication No. 3-36948, Japanese Patent Laid-Open Publication No. 2-269859, Japanese Patent Laid-Open Publication No. 2-269860, etc.)

As described above, it is demanded to provide such a nonwoven fabric having strength equivalent to a woven fabric as well as being excellent in softness, puffiness (low bulk density), and having high ductility and good touch feeling. It is also desired that a nonwoven fabric has a uniformity, because its practical value is lost if the uniformity in the basis weight is poor in a high strength nonwoven fabric.

An object of the present invention is to develop a nonwoven fabric which can be used suitably for the utilities most equal to those of woven fabrics such as disposable clothing, base fabrics for synthetic leather or artificial leather, which could not be attained hitherto with the conventional nonwoven fabrics, with the addition of characteristic features including strength as well as uniformity, good touch feeling, bulkiness and thinness.

Moreover, another object of the present invention is to provide a nonwoven fabric which can be used suitably for applications of packaging materials, construction materials or else, which fabric have a high value in the biaxial work of rupture (which will be described later) which value could not obtained in the conventional nonwoven or woven fabrics, so that the resulting nonwoven fabric is thin and economically used for the above purposes.

In addition, the nonwoven fabric must be produced inexpensively and it has various uses, so that small quantities of nonwoven fabrics in many kinds are must be produced. In this respect, according to conventional manufacturing processes, it was difficult to produce a nonwoven fabric which is particularly excellent in both the strength and bulkiness at low cost.

Accordingly, it is desired to provide a novel method for manufacturing a nonwoven fabric in which method a highly improved bulkiness and good touch feeling which are characteristic to the nonwoven fabric can be realized together with the solution to the above described problems in strength, uniformity and dimensional stability of nonwoven fabrics. Moreover, it is desired that the method is suitable for producing many kinds of product in relatively small quantities without losing the advantage in economy.

BRIEF DESCRIPTION OF THE DRAWINGS

FIG. 4 (B) is a cross-sectional view of the die shown in FIG. 4 (A) in which two kinds of polymers are used;

FIG. 6 (B) is a partially exploded perspective view showing the die shown in FIG. 6 (A);

FIG. 8 (B) is a front sectional view showing an extreme end section of the die of FIG. 8 (A);

FIG. 8 (C) is a side view showing the extreme end section of the die shown in FIG. 8 (B);

FIG. 12 (B) is a side view showing the apparatus of FIG. 12 (A);

DISCLOSURE OF THE INVENTION

Figures 1A, 1B, 1C, 1D, 1E:
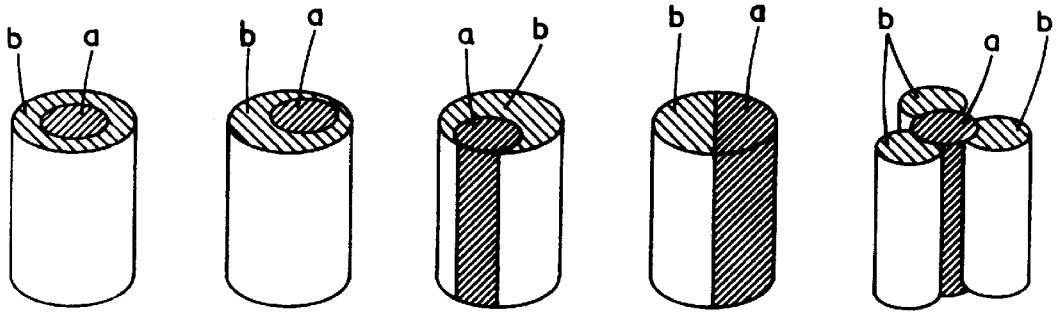
FIGS. 1 (A) to 1 (I) are partially cross-sectional enlarged perspective views, each showing a part of a conjugate filament.

As a result of an eager study for achieving the above described objects by the present inventors, it has been found out that when a plurality of polymers having different properties are combined in the spinning operation, the problems involved in the prior art can be solved, so that the present invention has been accomplished.

More specifically, the first invention of this application relates to a nonwoven fabric of stretched filament of different kind polymers which is characterized in that filament web comprising long filaments formed of a plural kind of thermoplastic polymers of different properties is stretched and the long filaments are aligned as a whole in one direction.

Furthermore, the second invention of the present application relates to a nonwoven fabric of stretched filament of different kind polymers in the first invention which is characterized in that a strength of the above described long filaments in the aligned direction is 1.5 g/d or more.

Moreover, the third invention of this application relates to a nonwoven fabric of stretched filament of different kind polymers in the first invention, which is characterized in that the above described long filaments are assemblies of conjugate filaments formed of a plural thermoplastic polymer of different properties.

Further, the fourth invention of this application relates to a nonwoven fabric of stretched filament of different kind polymers in the first invention, characterized in that the above long filaments are mixture of a plural filament having different properties.

Still further, the fifth invention of this application relates to a nonwoven fabric of stretched filament of different kind polymers in the first invention, characterized in that still other fiber web is laminated on the above described stretched filament webs.

Yet further, the sixth invention of this application relates to a nonwoven fabric of stretched filament of different kind polymers in the fifth invention, characterized in that the direction of the above described other fiber web intersects with the direction of the long filaments of the above described stretched filament webs.

Still further, the seventh invention of the present application relates to a nonwoven fabric of stretched filament of different kind polymers in the sixth invention, characterized in that the strength in the crosswise aligned direction, the biaxial work of rupture, and the bulk density are 0.5 g/d or more, 0.2 g/d or more, and 0.1 g/cc or less, respectively.

Yet further, the eighth invention of this application relates to a nonwoven fabric of stretched filament of different kind polymers in the first invention, characterized in that at least a part of filaments of the above described long filaments are crimped.

Furthermore, the ninth invention of this application relates to a method for manufacturing a nonwoven fabric of stretched filament of different kind polymers, characterized by the steps of preparing a filament web comprising long filaments which are substantially free from molecular orientation, from a plural kind of thermoplastic polymers of different properties, and stretching the filament web in one direction to obtain a stretched filament web.

Moreover, the tenth invention of this application relates to a method for manufacturing a nonwoven fabric of stretched filament of different kind polymers in the ninth invention, characterized by the provision of a further step of shrinking the above described stretched filament web to crimp the same.

Further, the eleventh invention of this application relates to a method for manufacturing a nonwoven fabric of stretched filament of different kind polymers in the tenth invention, characterized by the provision of a further step of laminating the stretched filament web after it was crimped with another aligned nonwoven fabric so as to intersect their aligned directions one another.

Still further, the twelfth invention of this application relates to a method for manufacturing a nonwoven fabric of stretched filament of different kind polymers in the ninth invention, characterized by the provision of a further step of laminating the stretched filament web with the other aligned nonwoven fabric so as to intersect their aligned directions one another and thereafter, shrinking them in at least one aligned direction to crimp the same.

Yet further, the thirteenth invention of this application relates to a method for manufacturing a nonwoven fabric of stretched filament of different kind polymers in the ninth invention, characterized in that the above described long filaments are aggregation of conjugate filaments formed of a plurality of thermoplastic polymers of different properties.

Still further, the fourteenth invention of this application relates to a method for manufacturing a nonwoven fabric of stretched filament of different kind polymers in the ninth invention, characterized in that the above described long filaments are mixtures of a plurality of filaments having different properties.

Yet further, the fifteenth invention of this application relates to a nonwoven fabric of stretched filament of different kind polymers, characterized by the provision of a first web layer mainly composed of crimped filaments and a second web layer which is laminated on the first web layer and mainly composed of stretched long filaments having different properties from those of the filaments of the above first web layer and being scarcely crimped; and having a strength of 0.5 g/d or more at least in one direction and a bulk density of 0.1 g/cc or less.

Still further, the sixteenth invention of this application relates to a method for manufacturing a nonwoven fabric of stretched filament of different kind polymers, characterized by the provision of the steps of laminating the first web with the second web having different shrink characteristics to form laminated webs; and joining the above laminated webs together to form a joined web and shrinking the joined web simultaneously with the joining or after the joining step, thereby forming crimp therein.

Yet further, the seventeenth invention of this application relates to a method for manufacturing a nonwoven fabric of stretched filament of different kind polymers in the sixteenth invention, characterized in that the laminated web forming step is provided with a step for preparing the above described first and second webs comprising separately long filaments without accompanying substantially molecular orientation formed from different kind polymers exhibiting different shrink characteristics when stretched; and a step for piling up these first and second webs and stretching them in at least one direction.

Still further, the eighteenth invention of this application relates to a method for manufacturing a nonwoven fabric of stretched filament of different kind polymers in the sixteenth invention, characterized in that the laminated web forming step is provided with a step for preparing the above described first and second webs comprising separately long filaments without accompanying substantially molecular orientation formed from different kind polymers exhibiting different shrink characteristics when stretched; a step for stretching separately these first and second webs; and a step for laminating these stretched first and second webs in such that the filaments thereof are aligned in the identical direction.

Yet further, the nineteenth invention of this application relates to a method for manufacturing a nonwoven fabric of stretched filament of different kind polymers in the sixteenth invention, characterized in that at least one of the first and second webs exhibits rubber-like elastic recovery performance in an unstretched state.

The polymers of different properties used in the present invention (hereinafter referred to as "different type polymers" may be the ones which have any difference in their melting points, degrees of swelling, shrink characteristics after stretching, spontaneous elongation, adhesion properties and the like. When polymers having different properties are combined, a nonwoven fabric having good touch feeling can be obtained. The filaments which are not subjected to heat-treatment, particularly polyethylene terephthalate filaments, are not shrunk by heat treatment, but they are sometimes extended to the contrary, which is called as spontaneous extension.

The above described different type polymers include those belonging to the same kind polymers but having different molecular weights, molecular weight distributions, branching degrees and tacticities. Furthermore, several kinds of copolymers and blended products can also be used as the different type polymers. In addition, when an additive or a plasticizer or else is added to a certain polymer, it may also be employed as a different type polymer. By the way, a combination quite different polymers such as polyamide and polyester, may also be used as the different type polymers.

When the mixed filaments are employed as the above different type polymers, different polymers are spun through a single nozzle or they may be spun through separate nozzles. With respect to a basic polymer which can be used as a reinforcing material in a crosswise layered nonwoven fabric with substantial molecular orientation, the mixing ratio of another different type polymer is an equal amount or less as compared with the amount of the basic polymer, and it is desirable that the ratio of the different type polymer is 5% or more, preferably 20% or more, by weight relative to the total amount.

In the following, in order to avoid the complexity in explanation, only the case in which two kinds of polymers are used as different type polymers will be described, but it should be noted also that, as a matter of course, more kinds of different type polymers may also be combined.

Examples of polymers which can be used as reinforcing materials in the filaments of the present invention include thermoplastic resins, for example, polyolefin resins such as polyethylene and polypropylene; polyesters; polyamides; polyvinyl chloride resins; polyurethane; fluorocarbon resins as well as modified resins of them. Moreover, materials prepared by wet-spinning or dry-spinning of polyvinyl alcohol resins, polyacrylonitrile resins or else, may also be employed.

In the case that adherent polymers are used in the present invention, the resins having melting points different from those of the above described polymers; modified resins of them; or modified olefin resins such as ethylene-vinyl acetate copolymer and acid-modified polyolefin; and resins used as hot-melt adhesives can be employed.

The wording "nonwoven cloth (or fabric) of stretched filament of different kind polymers" used in the present invention means a nonwoven fabric containing stretched filament webs which are prepared by stretching filament webs comprising long filaments formed of a plural kind of thermoplastic polymers having the above described different properties, the long filaments as a whole being aligned in one direction. In the stretched long filaments, there is substantially molecular orientation, and a strength per denier is, as a filament, at least 1.5 g/d or more, preferably 2.5 g/d or more, and more preferably 3 g/d or more. Some ordinary nonwoven fabrics have the strength in one direction of approximately 1 g/d, however, the spunbonded nonwoven fabric having relatively good feeling exhibits poor strength. Moreover, some of tow-opening nonwoven fabrics and flush-spun nonwoven fabrics, are strong to some extent in one direction, but they are in paper-like appearance and the touch feeling is poor. In addition, the flushspun nonwoven fabrics are expensive.

The term "long filaments" herein referred to means those the greater part of which is substantially composed of long filaments. More specifically, the most part of them comprises the filaments of 100 mm or more in length, which are different from the conventionally used short fibers of about 10 to 30 mm in length. Accordingly, short torn-off filaments formed in the stretching process can be contained partially in the final nonwoven fabric products.

Furthermore, the term "filament webs being aligned in one direction as a whole" means the webs in which the greater part of long filaments of the same are aligned in a certain direction within its plane, and such webs can be produced generally by stretching unstretched webs.

In the present invention, the following various spinning means can be utilized for manufacturing the filament webs comprising long filaments and the nonwoven fabrics containing such filament webs.

<Spinning Means 1>

When the stretched long filaments contain the conjugate-spun filaments having an adherent polymer layer on the surface thereof, a nonwoven fabric of soft and good feeling can be obtained (adherent conjugate type).

<Spinning Means 2>

Two types of polymers having different shrink characteristics after stretching are supplied into a single spinning nozzle to spin filaments of two-layer structure, the filaments are then stretched, and the stretched filaments are further shrunk to produce a number of crimps in the filaments, with which an cross-laminated nonwoven fabric of soft and good feeling comprising stretched long filaments of high strength and ductility can be obtained (bulky conjugate type).

<Spinning Means 3>

Different type polymers are introduced into a single spinning nozzle in multiple layers, and filaments thus spun through the spinning nozzle are subjected to either stretching or mechanical processing with water jet to separate the different type polymers, whereby an cross-laminated nonwoven fabric of soft and good feeling comprising stretched long filaments of fine denier can be obtained (conjugate filament-mixed filament type).

<Spinning Means 4>

Different type polymers including either a lower melting point type or adhesive type are introduced into separate nozzles, and these polymers are mixed and spun integrally to prepare an cross-laminated nonwoven fabric of soft and good feeling (adhesive mixed filament type).

<Spinning Means 5>

When different type polymers having different shrink properties after stretching, are introduced into separate nozzles to conduct mixed spinning, an cross-laminated nonwoven fabric of soft and good feeling can be obtained, which fabric comprises a mixture of filaments which are in a shrunk and stretched state and other filaments which are loosen and bent with no or slight shrinkage (bulky mixed filament type).

<Spinning Means 6>

Different type polymers having different shrink properties after stretching are separately spun to prepare separate webs, each composed of filaments with substantially no molecular orientation, and these webs are stretched in at least one direction, respectively, to join them together, thereby obtaining a nonwoven fabric (shrinkable web laminated filament type).

As the means other than the above, there is a manner wherein a polymer of spontaneous extensibility by stretching is combined with a usual polymer which is given shrinkability as a result of stretching, and the above described spinning means 2, 5 or 6 may be applied to the combined polymers. In this respect, however, because the spontaneous extensibility may be regarded as negative shrinkage, the manner discussed herein will be included in the above described spinning means 2, 5 and 6 in the present invention.

Any of these spinning means may be used independently or in combination.

The details of these spinning means will be described further in the following examples.

The manner according to the above spinning means 6 is applied to the method of manufacturing a stretched filament nonwoven fabric exhibiting excellent strength and bulkiness (hereinafter referred to as "bulky stretched filament nonwoven fabric") disclosed in the fifteenth invention of this application. In the following, the invention will be described in detail.

In the first place, it is necessary to use a plurality of webs having different shrink properties in a joining process or a shrinking process after that. As one of the means (method A) therefor, there is a manufacturing method wherein a plurality of filament webs of different properties are separately prepared, thereafter these webs are overlapped together and stretched simultaneously to form a laminate of stretched filament webs having different properties, and then the resulted web laminate is shrunk to obtain a nonwoven fabric having excellent bulkiness.

Another means (method B) is a method in which a plurality of stretched filament webs of different properties are combined and joined together, and then they are subjected to shrinking. The plural webs include the cases in which the directions of stretching of them are identical (B-1) and the directions are different (B-2).

As still another means (method C), there is a method in which a stretched filament web is combined with a nonwoven fabric other than the stretched filament web, and the combined materials are subjected to shrinking process after they are joined together.

The point that is common in the above described methods is that at least one of stretched filament web is used in the plural types of webs, and shrinkability of the stretched filaments is utilized. More specifically, the stretched filament web having a high shrinkage factor is combined with another web having a relatively low shrinkage factor, and they are shrunk after both of them are joined together. As a result, the web having a low shrinkage factor (hereinafter referred to as "low shrinkable web") is crimped due to the shrinkage of the web having a higher shrinkage factor (hereinafter referred to as "shrinkable web"), thereby the bulkiness of the resulted nonwoven fabric can be increased.

In both the webs as described above, it is preferable that the difference between both the shrinkage factors is at least 10% and preferably 30% or more at a shrinking temperature.

The shrinkage can be caused to occur not only by heat but also by the presence of a swelling agent such as water or else.

Webs of different shrinkage factors include the one which is extended spontaneously due to heating and the shrinkage factor in such a case is considered as negative value.

In the above described cases, a variety of webs may be employed as a low shrinkable web which produces crimps. They are exemplified in the following.

(1) The material may be a stretched filament nonwoven fabric which is the same as the shrinkable web.

However, it is required to have a different shrinkage factor from that of the shrinkable web, and in this case, both the different webs are those prepared from different type polymers or those prepared from the same polymer and being followed by the processing of different stretching temperatures, stretching ratios, heat-treating conditions and the like.

The different type polymers include those prepared from materials of chemically different kinds, and as a matter of course, include polymers belonging to the same kind so far as their melting points, molecular weights, molecular weight distributions, degrees of branching, tacticities and the like are different. Furthermore, when several copolymers or blends are prepared from a certain polymer, they may be used as different type polymers. There is also a case in which a certain polymer may be employed as a different type polymer when any additive or plasticizer is added to the polymer. It is possible to use a combination of quite different types of polyamide and polyester.

(2) In the case of combination of a shrinkable web and a low shrinkable web of another type, the difference in the aligning direction of stretched filaments may be utilized. For instance, in the longitudinal monoaxial stretching, transverse monoaxial stretching and biaxial stretching, it is possible to employ a stretching method which gives different alignment of filaments in a shrinkable web and a low shrinkable web, and in addition, if desired, heat-treatment may be combined with the above. In this case, the lamination of only a web in longitudinal direction and a web in transverse direction does not produce a high bulkiness. For example, when the web in longitudinal direction is a shrinkable web and the web in transverse direction is a low shrinkable web, no crimp is produced, but merely a spacing defined between filaments becomes narrower in the web in transverse direction. Accordingly, it is required in this case to take the laminating structure as shown in FIG. 13 (C) which will be described later.

(3) Even if a low shrinkable web is another nonwoven fabric, for example, a commercially available nonwoven fabric such as tow-opened nonwoven fabric, spunbonded nonwoven fabric and melt-blown nonwoven fabric, they can be used so far as their shrinkage factors differ from that of the shrinkable web.

(4) Another example of low shrinkable webs includes the one which is prepared by opening crimped filament tows to spread the width thereof. In general, the stuffing box method is adopted for the crimping of filament tow. For opening and spreading width, a combination of bent bars is utilized, and in this respect, the methods as described in Japanese Patent Publication No. Sho 46-43275 and Japanese Patent Application No. Hei 7-231904 are particularly preferred for widely and uniformly spreading the width of a filament tow.

There is a method for combining a heat-treated web with another web which is not heat-treated as an effective means for affording a difference between shrinkage factors in both the webs. More specifically, webs are heat-treated sufficiently in the preparation of a low shrinkable web. Either dry or wet heat treatment is adopted dependent on the type of web. Furthermore, there are stretching heat treatment and shrinking heat treatment, and the shrinking heat treatment is most suitable for preparing a low shrinkable web.

As described above, the basic polymer is stretched long filaments in the case of the spinning means 6, so that molecular orientation is substantially effected in its stretched state. In this case, the strength as filament must be at least 1.5 g or more per denier, preferably 2.5 g, and more preferably 3 g or more as in the case of the stretched filament nonwoven fabric prepared from the aforesaid different type polymers.

The long filaments to be used may be substantially the same as those described above and unlike the ordinary nonwoven fabric in which filaments having a length of around 10 to 30 mm is used, it is sufficient that the most part of filaments have a length of 100 mm or more. Accordingly, a final product of nonwoven fabric may contain partly such filaments which were broken during the spinning, stretching and laminating steps.

As a spinning machine to be used in the method of the present invention, those of conventional melt-blowing die type, spunbonding nozzle type and the like may be employed. Besides, any of the spinning means as disclosed in Japanese Patent Publication No. Hei 3-36948 (unidirectionally alignd spinning type) and Japanese Patent Laid-Open Publication No. Hei 2-269859 (fluid rectifying method), etc. can be employed.

The above described spinning means are fundamentally different from conventional spunbonding type spinning means in the point that filaments are taken up while positively heating the same by infrared rays or hot air immediately after the nozzle section, or employing hot air for an air sucker, that is, the filaments are taken up while suppressing molecular orientation in the spinning as far as possible. Thus, the occurrence of molecular orientation of the filaments is reduced, whereby a stretchable property in the post-stretching process of the web is made good.

As a stretching means used in the present invention for manufacturing molecular-oriented long filaments prepared from different type polymers, longitudinally stretching means, transversely stretching means, and biaxially stretching means which were employed conventionally for stretching films or nonwoven fabrics, besides a variety of stretching means disclosed in the present inventors' Japanese Patent Publication No. Hei 3-36948 may also be used.

That is, the intra-rolls proximal stretching (the stretching method through a stretching gap formed between two stretching rolls mounted in closely spaced apart relation to each other) is suitable as a longitudinally stretching means, because the stretching can be effected without narrowing the width of a film. In addition, the means for rolling, hot air stretching, hot water stretching, steam stretching and hot plate stretching can also be used.

As a transversely stretching means, while a tenter method which is used for biaxial stretching of films may be employed, a pulley type transversely stretching method illustrated in Japanese Patent Publication No. Hei 3-36948 (hereinafter referred to as "pulley type") or a transversely stretching method wherein grooved rolls are combined (grooved roll stretching) is simple, so that it is suitable to be employed.

While a simultaneous biaxially stretching method of tenter type which is used for biaxial stretching of films is applicable for the biaxially stretching means, the biaxial stretching can be attained also by combining the above described longitudinally stretching means with the transversely stretching means.

The stretching ratio of the stretched filament nonwoven fabric according to the present invention is in the range of 5 to 20 times, and preferably from about 7 to 15 times.

The term "stretching" means usually the effect that molecular orientation is produced as a result of extension, and the state of molecular orientation is maintained substantially after the extension. In the present invention, such a case where a material having rubber elasticity presents molecular orientation in a stretched state is contained also in the category of stretching, even if it returns reversibly to the original state when the tension is released.

It is to be noted that, in the present invention, the molecular orientation is discriminated from the alignment of filaments themselves, i.e., the orientation means the average direction of molecules in filaments, while the alignment means the mutual disposition of filaments.

The present invention includes a nonwoven fabric prepared by laminating a stretched filament web and a web of either the same type or another aligned filament nonwoven fabric so as to intersect their axes of alignment. In this case, the "another aligned filament nonwoven fabric" may contain also filament webs.

In the nonwoven fabric obtained by laminating webs of different aligned directions according to the present invention, both of crosswise and obliquely intersecting ways are applicable to the case of laminating either of longitudinally aligned webs or transversely aligned webs. While preferable one is cross-laminated nonwoven fabric, the essential point relating to the intersection is in that webs may be so laminated as to intersect the axes of alignment of filaments, so that the manner therefor is not particularly limited. In addition to the crosswise and obliquely laminating manners, webs may be laminated in a multiplex manner in such a way that the axes of alignment are cross-laminated in various directions, so that the strengths in all directions can be balanced within a plane.

The intersecting lamination method of stretched filament webs according to the present invention is represented by the method of laminating a transversely stretched web and a longitudinally stretched web (longitudinal stretching-transverse stretching lamination method . . . Method 1) disclosed in Japanese Patent Publication No. Hei 3-36948 which is a prior invention made by the present inventors, and a method according to a crosswise laminating machine (crosswise laminating method . . . Method 2). In this connection, it is not necessarily required that the axes of alignment in fibers are cross-laminated, but they may be laminated in somewhat obliquely intersected manner.

The cross-laminated laminates in the present invention includes those in which the alignment of long filaments is either in crosswise intersection or in oblique intersection as described above, so that it is sufficient that a layer aligned in one direction is laminated with other layer or layers aligned in different directions. In the following, cross-laminated nonwoven fabrics will be described as typical embodiments.

The term "alignment of filaments" used herein does not mean the filament axes in microscopic observation but the overall alignment of long filaments composing the web. In other words, a longitudinally aligned web means a web in which most filaments are aligned as a whole in the longitudinal direction.

In the present invention, at least one method selected from the group consisting of water jet method, through-air method, adhesive bonding method, thermally embossing method, ultrasonic bonding method, high-frequency wave bonding method, needle-punch joining method, and stitch bonding method may be employed as a means for laminating stretched filament webs, and joining or entwining the layers of webs.

Moreover, the emulsion bonding or the whole surface bonding by heating as illustrated in the above described patent gazettes which were proposed by the inventors of the present application are also available. However, to obtain a nonwoven fabric of soft and good feeling which is an object of the present invention, it is particularly effective to adopt the following methods.

One of them is a partial bonding method such as the bonding with a heat-embossing roll, the ultrasonic bonding, and the bonding with an emulsion. These methods are particularly effective for carrying out the bonding to obtain a nonwoven fabric of soft and good feeling. Other partial bonding methods such as powder dot bonding and emulsion dot bonding are also employed.

In the mixed spinning of conjugate filaments and adhesive polymers, thermally embossing method and ultrasonic method are useful. In the case of mixed spinning method for heat-shrinkable polymers, dot bonding with an adhesive powder or an adhesive emulsion is effective when no adhesive polymer is contained. In this case, when filaments having a different heat shrinkage factor are spun together, the advantage such as softness is further improved.

As a still further bonding means, a bonding method in which hot air is passed through filaments is particularly effective for conjugate filaments or in the case where adhesive polymers are spun together. When filaments of these adhesive polymers are spun together with filaments having different heat shrinkable property, the advantages in softness and the like are further improved (through-air method). In this case, hot air is supplied in the form of jet stream to laminate and bond them by the fluid sewing effect.

As an yet further bonding method, filaments are sewn by the use of jet stream of a fluid such as water jet to perform the laminating and joining of the filaments. Moreover, mechanical bonding methods such as needle punching method and stitch bonding method are also particularly useful as the manufacturing method of soft nonwoven fabrics. In this case, when other filaments having a different heat shrinkability are spun together and the resultant material thus spun is subjected to thermal processing according to through-air method or the like after mechanical joining thereof, it is possible to obtain softer product. In addition to the sewing effect in this mechanically bonding method, it is also possible to separate different type polymers after stretching process of the same, and further to positively divide the filaments in the case where different type polymers are spun through a single nozzle in multiple layers, whereby there is also an advantage of obtaining extremely fine fibers.

In the present invention, it is not always necessary that different type polymers are evenly distributed inside a nonwoven fabric. For example, a major part of a polymer is allowed to exist in surface portions or in the boundary portion of the nonwoven fabric in the case of adherent filaments, while a major part of different type polymer is contained in the internal part of a nonwoven fabric in the case of filaments which are arranged so as to vary shrinkability to bend them. That is, a variety of combinations of polymers are possible.

The nonwoven fabric containing laminates according to the present invention is characterized by the strength which is equal to that of woven fabrics, and the strength in the longitudinal or transverse direction of the nonwoven fabric is 0.5 g/d or more, preferably 0.8 g/d or more, and more preferably 1.2 g/d or more. The reason why the unit of the strength is indicated with grams per denier is that the comparison of values with the ordinary units of per $cm^2$ or per 30 mm width, is difficult in nonwoven fabrics having different basis weights and different bulk densities.

The strength of conventional nonwoven fabrics is around 0.4 to 0.8 g/d in longitudinal direction even in the relatively strong spunbonded nonwoven fabric, while the strength in transverse direction is 0.3 g/d or less, which is markedly inferior to the strength of woven fabrics.

Since it is practically insufficient that even if the strength of nonwoven fabrics is high in only one direction, the sum of breakdown strengths in longitudinal and transverse directions is used as "biaxial work of rupture" for the evaluation of practical performance of nonwoven fabrics in the present specification. A larger numeric value means higher practical utility in the same uses as those of woven fabrics such as base fabrics for synthetic leather or artificial leather, nonwoven fabrics for construction, clothes, packaging materials, roofing materials for buildings and the like.

Although the highest strength is not always required in the longitudinal direction or in the transverse direction as to the aligned directions in laminates, because of the necessity for avoiding complexity and of the larger frequency of uses in which longitudinal or transverse directions are regarded as important, the above described evaluation method is employed in the present invention.

The present invention includes a fabric prepared by laminating another nonwoven fabric on either or both surfaces of stretched filament nonwoven fabric produced from the aforesaid different type polymers to entangle them, and a fabric prepared by laminating nonwoven fabrics each comprising the above described stretched filament webs on both the surfaces of another nonwoven fabric of a core material to entangle them with each other.

Another nonwoven fabric used in the present invention includes webs prepared from natural fibers, regenerated fibers or synthetic fibers; and nonwoven fabrics manufactured by employing the webs. Specific examples of such fibers include natural fibers such as cotton, linter, pulp and the like; regenerated fibers such as rayon, cuprammonium rayon and the like; semisynthetic fibers such as acetate fiber and the like; synthetic fibers such as those prepared from polyethylene, polypropylene, polyester, polyamide, polyacrylonitrile, acrylics, polyvinyl alcohol and the like; polyurethane-base elastomer fibers; conjugate fibers; split-type conjugate fibers which are made by splitting into very fine fibers by means of high-pressure water streams; or the mixtures thereof. An example of a manner for forming webs includes a method wherein either a material obtained by wet-spinning a regenerated fiber or a material obtained by melt-spinning a synthetic fiber in accordance with a normal manner is cut off, and the fibers thus cut off are combed by means of a carding machine to form webs; spunbonding method or melt-blowing method wherein a thermoplastic resin is spun to form directly webs; a method wherein natural fibers are combed by means of a carding machine to form webs or they are beaten to make papers; and the like methods.

The single filament fineness of the fibers used for the above described other nonwoven fabric is preferably 0.01 to 15 denier, and more preferably 0.03 to 5 denier, while the length of the fibers is preferably 1 to 100 mm, and more preferably 10 to 60 mm. When a single filament fineness is less than 0.01 denier, it results in inferior lint freeness, while feeling becomes poor when it exceeds 15 denier. Furthermore, when a length of the fibers is less than 1 mm, the twining is insufficient so that the strength is low, while when it exceeds 100 mm, the dispersibility becomes poor so that it is not desirable.

Furthermore, the basis weight of webs is preferably 10 to 150 g/m$^2$, and more preferably 20 to 50 g/m$^2$. When the basis weight is less than 10 g/m$^2$, unevenness appears in the density of fibers in the case of processing by means of high pressure water stream, while when it exceeds 150 g/m$^2$ the web is neither thin nor light in weight which are not desirable.

As a characteristic property indicating feeling in nonwoven fabrics, there is a bulkiness. In this connection, there are many nonwoven fabrics having high bulkiness in conventional ones, particularly dry type nonwoven fabric of short fibers. However, a nonwoven fabric having high bulkiness, in other words, low bulk density exhibits poor strength, so that any nonwoven fabric has not a high value of the above-mentioned biaxial work of rupture. Accordingly, there has been no nonwoven fabric which can be employed for the same applications as that of woven fabrics. In accordance with the present invention, it becomes possible to manufacture a nonwoven fabric having high bulkiness while maintaining high tensile strength as well as high value in biaxial work of rupture.

The longitudinal webs in the present invention may also be used by spreading their widths while maintaining the alignment in longitudinal direction. Furthermore, also in transverse webs, the basis weight can be adjusted by stretching or shortening the same in the longitudinal direction.

The present invention will be described further with reference to the accompanying drawings.

Figures 1F, 1G, 1H, 1I:
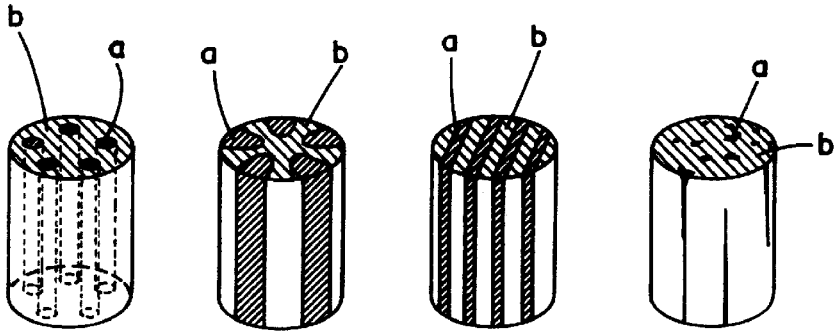

The drawings in FIG. 1 are enlarged perspective views each showing a part of the structure of a conjugate filament, in partly cross-section, which is prepared by extruding different type polymers used in the present invention through a single nozzle wherein the filaments of these structures are not peculiar to the present invention, but they are also employed in usual nonwoven fabrics. However, the present invention is characterized, as fully described hereinafter, in that webs each formed in a sheet-form are stretched while maintaining the web-shape, and thereafter they are laminated so as to intersect the alignment of filaments with each other. Namely, since the filaments constituting the nonwoven fabric according to the present invention have been sufficiently stretched, characteristics of conjugate filaments function more easily than that in the case of usual nonwoven fabrics.

FIGS. 1 (A) and (B) show examples of conjugate filaments each having a core-sheath structure wherein reference character a designates a major polymer, and b denotes an adherent polymer. According to the structure shown in FIG. 1 (B), crimp characteristic, which will be described hereunder, can be given to the filaments.

FIGS. 1 (C) and (D) show examples of conjugate filaments of side-by-side type which are utilized for crimping filaments to afford extensibility to the resulting nonwoven fabrics. In this respect, the polymer b is different from the polymer a in heat shrinkability after stretching and the former one may be an adherent polymer.

FIGS. 1 (E), (F), (G), (H) and (I) show examples of spun filaments in each of which different type polymers are used to obtain fine fibers wherein FIG. 1 (E) shows an example of composite filaments of different diameters and this is particularly suitable for dividing the filaments by means of stretching or water jet operation. Examples of nonwoven fabrics of fine fibers prepared from the filaments having structures shown in FIGS. 1 (E) to (I), respectively, are well known. However, the present invention differs fundamentally from those utilizing nonwoven fabrics in the form of short fibers as in conventional applications, in the point that webs composed of these filaments are thereafter stretched further, and the webs thus stretched are employed as a nonwoven fabric while maintaining the form of filaments. Moreover, the present invention differs also from conventional nonwoven fabrics in that stretched filament webs are employed in the form of intersected laminates.

The polymer a shown in FIGS. 1 (F), (G), (H) and (I) may be dissolved to remove the same later, or the polymer may be separated by means of stretching or the mechanical processing after that.

Figure 2:
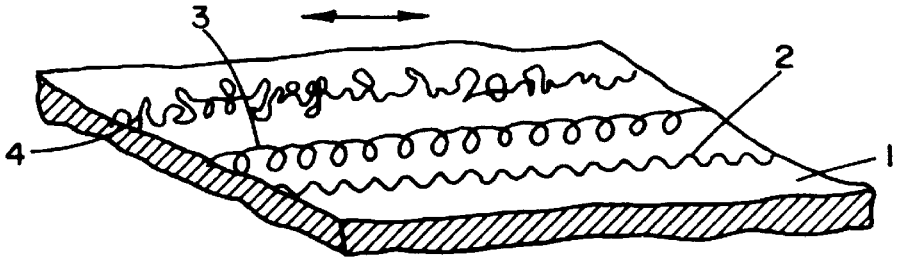
FIG. 2 is a schematic view showing a web composed of crimped filaments.

FIG. 2 is a schematic view illustrating the example of web constituting the nonwoven fabric of the present invention which is prepared by crimping conjugate filaments each having the structure shown in FIGS. 1 (B), (C) or (D).

In FIG. 2, filaments having a variety of crimped forms are shown in a web 1 wherein a filament 2 bends repeatedly to take a wave-form, a filament 3 is coil spring-shaped, and a filament 4 is crimped in a finely and irregularly bent state, respectively. The directions of these filaments are microscopically random, but they coincide with the longitudinal direction (the direction of the arrow in the figure) of the web as a whole.

While a crimped state of the filaments is illustrated schematically in FIG. 2, the crimped state is not composed of a single pattern in an actual nonwoven fabric, but different patterns of crimped filaments exist mixedly in most cases.

Moreover, although an example wherein the whole filaments are aligned along the longitudinal direction thereof in the web 1 illustrated in FIG. 2 is presented, such a web wherein crimped filaments are aligned transversely may be similarly produced, and the present invention includes also a nonwoven fabric prepared by laminating these longitudinally aligned webs and transversely aligned webs to join together in an cross-laminated manner.

To prepare crimped stretched filaments as shown in FIG. 2, it is necessary for crimping these filaments by heating the same while maintaining a sufficient free state along the longitudinal direction in the case of the longitudinally aligned filaments, whereas along the transverse direction in the case of the transversely aligned filaments.

Figure 3:
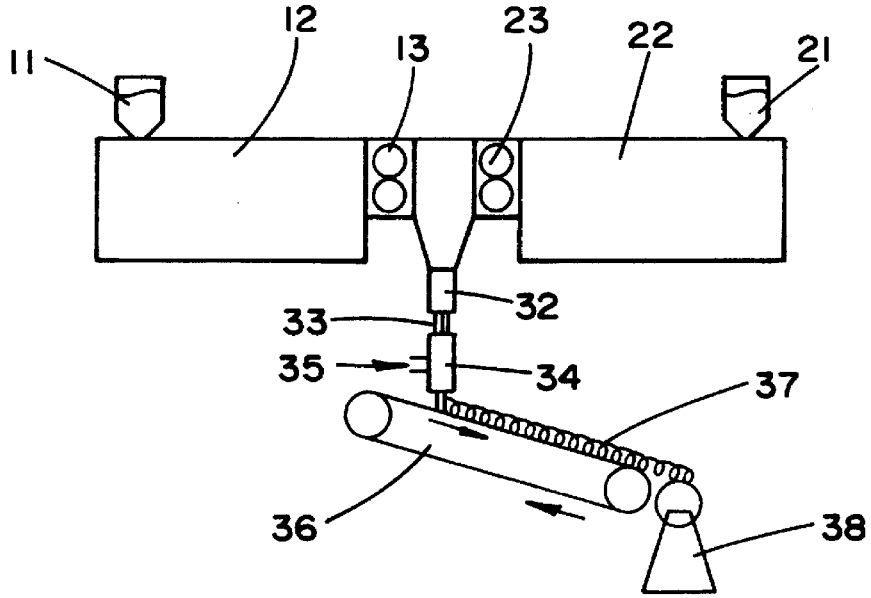
FIG. 3 is a schematic side view illustrating an example of an apparatus for extruding different type polymers from a single nozzle.

FIG. 3 is a side view schematically showing an example of an apparatus for extruding different type polymers through a single nozzle.

In the apparatus, different resins 11 and 12 are extruded from separate extruders 12 and 22 by means of gear pumps 13 and 23, respectively, and these resins are passed through a die 32 wherein a number of conjugate nozzles 31 (FIG. 4 (A) which will be described later) are disposed to form a group of the conjugate filaments 33. This group of the conjugate filaments 33 are sucked with a large amount of air 35 by the use of an air sucker 34 employed, for example, in manufacturing of spunbonded nonwoven fabrics.

To improve extensibility of filaments spun by the suction, it is required to suppress molecular orientation in the case of suction. For the sake of attaining the improvement, a large amount of the air 35 in the air sucker 34 is not employed as in the case of spunbonded nonwoven fabrics, and further it is desired that the air is utilized as hot air. In the case where cool air is employed in the air sucker, it is preferred that the group of the filaments 33 extruded from a nozzle is positively or negatively heated by the use of infrared rays, hot air or a heating tube (not shown).

The filaments which have been drafted by the air sucker 34 are collected on a conveyor 36 to form a longitudinal web 37, and is wound up by a winding machine 38.

In this case, when the conveyor 36 is inclined as shown in FIG. 3, the filaments can be efficiently aligned in the longitudinal direction. When the web 37 aligned longitudinally is stretched along the longitudinal direction, the web stretched longitudinally can be obtained.

Figure 4A:
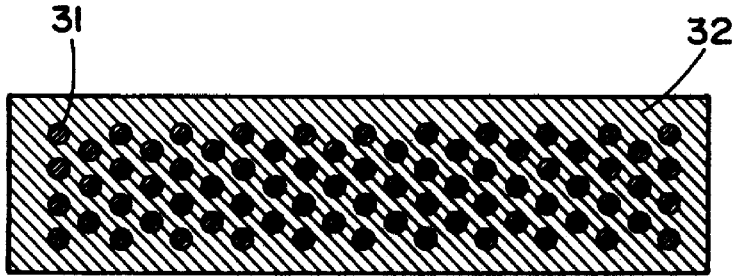
FIG. 4 (A) is a cross-sectional view of the die which is used in the apparatus shown in FIG. 3.
Figure 4B:
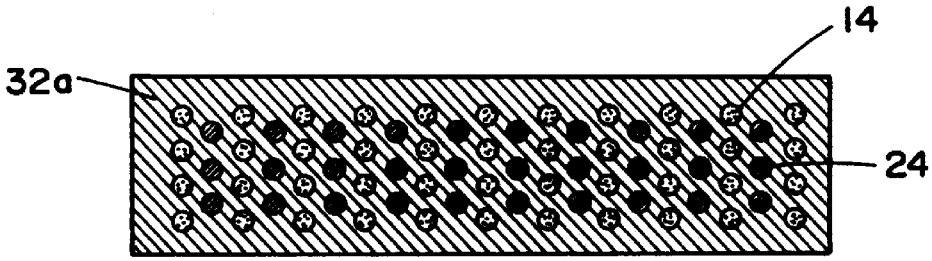

FIG. 4 (A) is a cross-sectional view showing the die for conjugate-spunbonded filaments used for spinning step conducted in FIG. 3 wherein through the nozzles 31 disposed on the die 32, a variety of conjugate filaments illustrated in FIG. 1 are spun.

As shown in FIG. 4 (B), the die 32a wherein nozzles 14 for extruding the resin 11 and nozzles 24 for extruding the resin 21 are arranged in a staggered form may be employed. Spun filaments are stretched similarly as described above to form a stretched web in which different types of filaments are entangled with each other.

Figure 5:
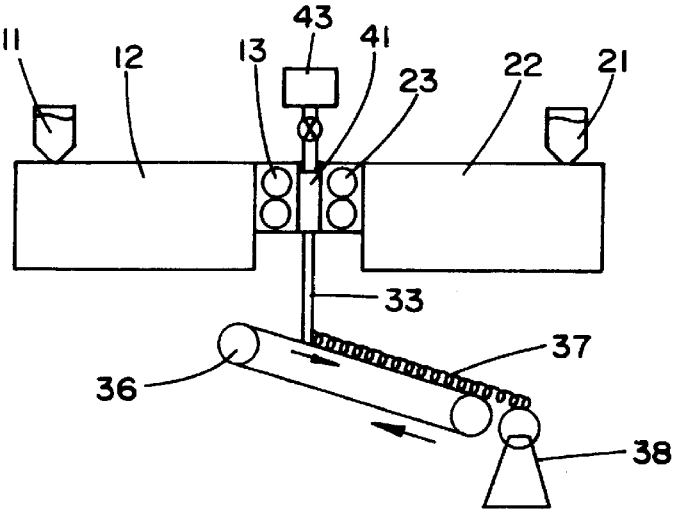
FIG. 5 is a schematic side view illustrating an example of a melt-blow spinning machine.

FIG. 5 is a schematic side view showing an example in the case when a melt-blow spinning machine is applied in the spinning step illustrated in FIG. 3.

Figure 6A:
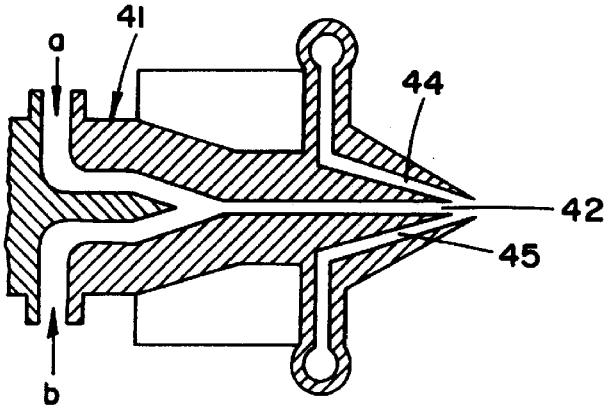
FIG. 6 (A) is a vertical sectional view showing an example of the die used in the apparatus of FIG. 5.
Figure 6B:
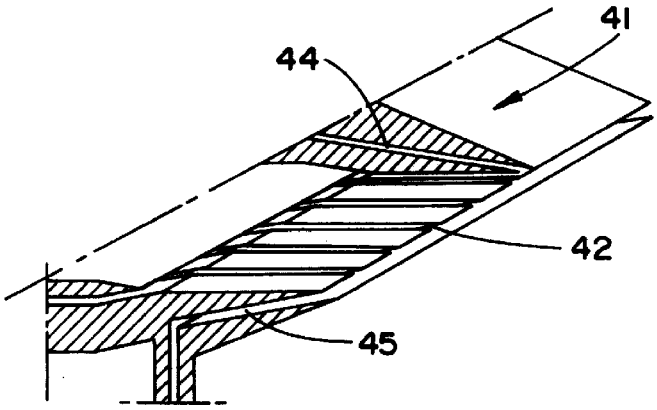

FIG. 6 (A) is a longitudinal sectional view showing an example of a conjugate die 41 in the melt-blow spinning machine shown in FIG. 5, while FIG. 6 (B) is a perspective view, in partially exploded state, showing the conjugate die 41. In FIG. 6 (A), different resins a and b are united through a nozzle 42 and extruded in a filament shape. The filament is heated by hot air passing through slits 44 and 45, respectively, and is blown off by the power of hot air.

FIGS. 6 (A) and (B) show an example of the melt-blow die in a conjugate manner, and in this case, a plurality of dies may also be employed to introduce the resins a and b so as to blow off the same through separate nozzles, respectively, to form combined filaments.

Merits of melt-blow method are in that since hot air derived from a hot air generator 43 is utilized at the time of extrusion, there is a low degree of molecular orientation of filaments so that the later extensibility becomes good, and in that a filament having a small denier value is obtained.

Figure 7:
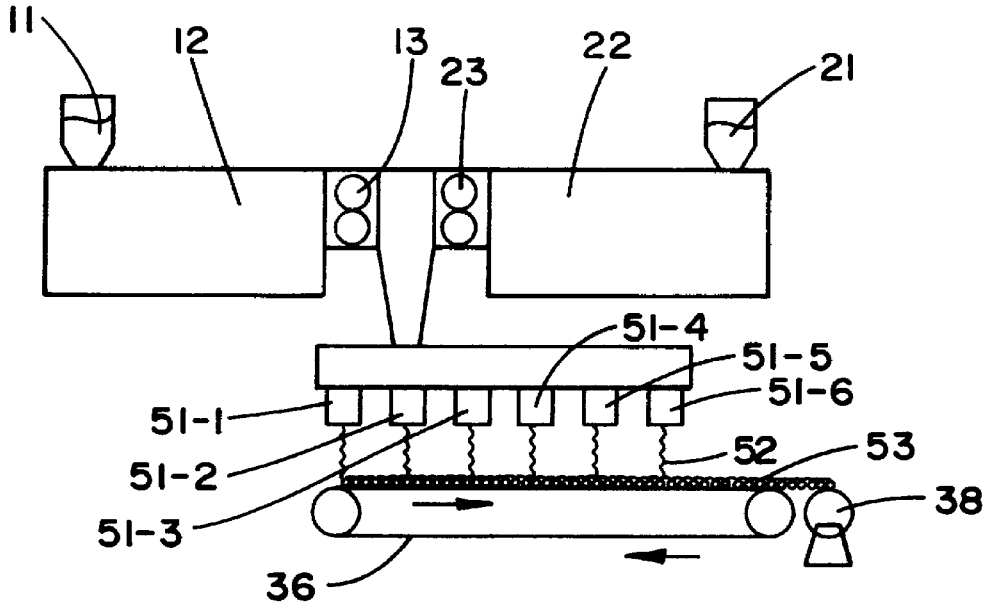
FIG. 7 is a schematic side view illustrating an example of an apparatus for manufacturing a mixed filament web for transversal stretching.

FIG. 7 is a schematic sectional side view showing an example of a production unit of different type incorporated filament webs for the use of transverse stretching wherein different resins 11 and 21 are extruded by gear pumps 13 and 23 with the use of separate extruders 12 and 22, and conjugate dies 51-1 to 51-6 each for a number of conjugate nozzles are aligned along the line direction. Filaments 52 being out from the nozzles are scattered in the direction perpendicular to the advance direction of the filaments by the action of hot air (not shown) to form a laminated body 53 composed of transversely disposed filaments.

Figure 8A:
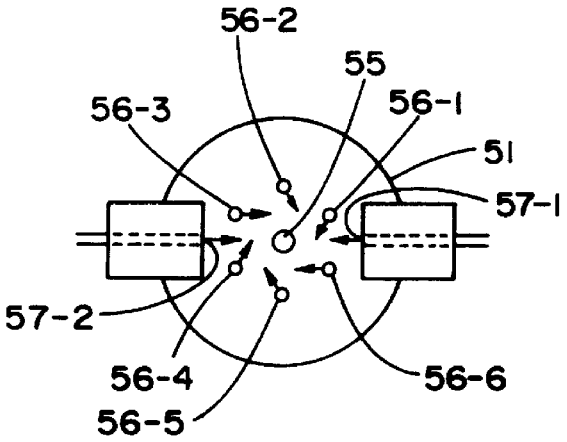
FIG. 8 (A) is a bottom view showing an example of the die used in the apparatus of FIG. 7.
Figure 8B:
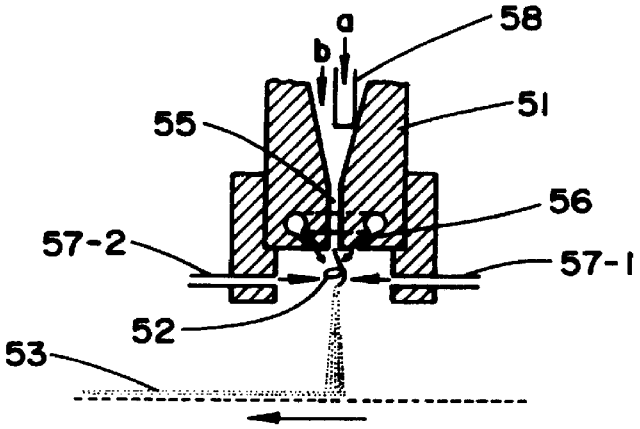
Figure 8C:
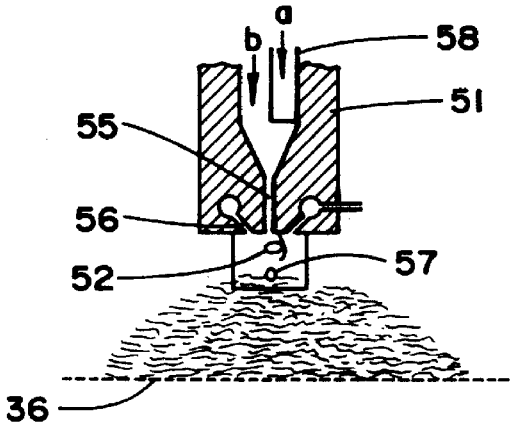
Figure 10A:
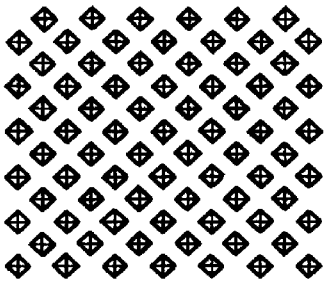
FIGS. 10 (A) to (D) are plan views showing examples of embossing patterns employed in a thermally embossing bonding operation, respectively.
Figure 10B:
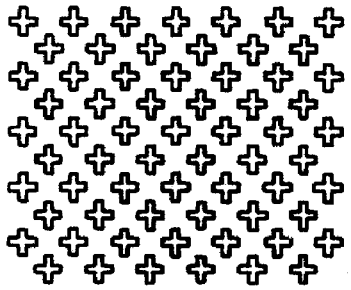
Figure 10C:
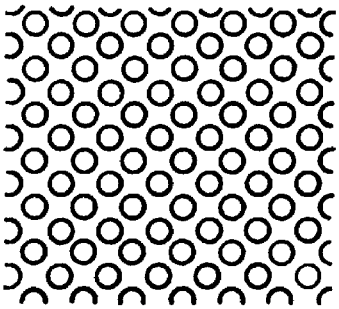
Figure 10D:
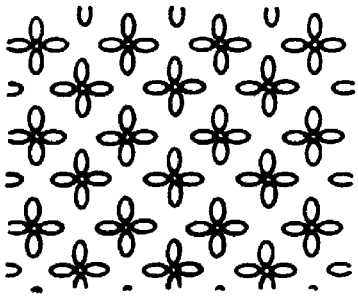

FIG. 8 shows an example of the structure of the die 51 in the apparatus shown in FIG. 7 in accordance with the manner described in the above-mentioned official gazettes, Japanese Patent Publication No. Hei 3-36948 and Japanese Patent Laid-Open Publication No. Hei 2-242960 by the present inventors. The manner is called by the name of "unidirectionally aligned spinning method" for such a reason that a spray gun-shaped die is utilized to spin filaments so as to unidirectionally align the same.

FIG. 8 (A) is a bottom view of the die 51, FIG. 8 (B) is a front sectional view showing an extreme end section of the die 51, and FIG. 8 (C) is a side view of the extreme end section of the die shown in FIG. 8 (B).

In the case that a conjugate filament composed of the resin a (which is derived from the resin 11 extruded from the extruder 12 and introduced into the nozzle) and the resin b (which is derived from the resin 21 extruded from the extruder 22 and introduced into the nozzle) is prepared in FIG. 8, primary air nozzles 56-1 to 51-6 are disposed around the periphery of the nozzle 55 in the die 51 of the spray gun-shaped, hot air blown off from secondary air nozzles 57-1 and 57-2 collides with vibrating filaments 52 by means of primary air (hot air), and the collided secondary air scatters in the direction perpendicular to the blown-off direction of the secondary air, whereby the filaments 52 are aligned along the scattering direction of the secondary air.

In FIGS. 8 (B) and (C), the resin a is introduced into the die 51 through a conduit 58, and a stream of the resins comprising a as a core and b as a sheath is formed in the die 51 to be guided into the nozzle 55.

Each of FIGS. 8 (B) and (C) shows the state wherein the filaments 52 are aligned in the direction perpendicular (transverse direction) to the advance direction of the conveyor 36.

While the conjugate dies 51-1 to 51-6 have been employed in FIG. 7, when these conjugate dies are not used, but, for example, the resin 11 is jetted from the dies 51-1, 51-3 and 51-6 and the resin 21 is blown off from the dies 51-2, 51-4 and 51-6, a mixed web composed of different kind filaments can also be manufactured.

In this case, if the resin 21 is an adherent polymer, the resin 21 is applied for only the foremost die 51-1 and the rearmost die 51-6, while the resin 11 is applied for an intermediate dies, respectively, so that it becomes also possible to form the surface layer of the laminated filament web from filaments of the adherent polymer 21.

For the sake of preparing a stretched filament web wherein transverse stretching action has been efficiently carried out to be sufficiently aligned transversely so that the strength thereof increases, it is required to spin the filaments aligned transversely.

A method for preparing transversely aligned webs is not limited to an example shown in FIG. 8, but a manner of employing the nozzle disclosed in Japanese Patent Laid-Open Publication No. Hei 2-269860, a manner according to the example disclosed in Japanese Patent Laid-Open Publication No. Hei 2-269859 (referred to provisionally as "fluid aligned method") or the like is also applicable to the aforesaid method.

Figure 9:
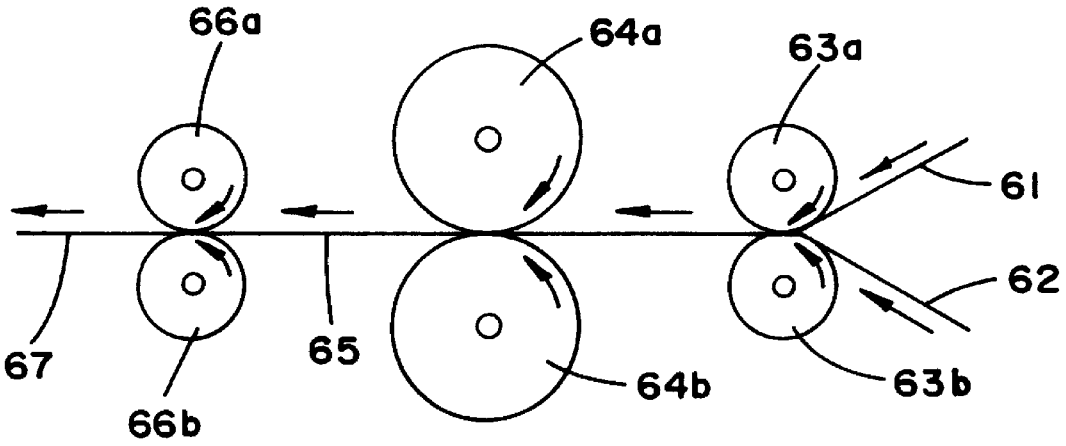
FIG. 9 is a schematic side view illustrating an example of a thermally embossing bonding machine.

FIG. 9 is a schematic side view illustrating an example wherein a thermal embossing bonding method is adopted as a bonding manner after longitudinal and transverse laminating operation was completed. In FIG. 9, a longitudinally stretched web 61 and a transversely stretched web 62 prepared from different type polymers are shaped by means of an embossing roll 64*a* and a backing roll 64*b* while taking up the webs with nip rolls 63*a* and 63*b*. The embossing roll 64*a* and the backing roll 64*b* have been heated, so that the heat derived therefrom shrinks the webs, whereby it is possible to crimp the same. In that case, it is necessary that a peripheral speed of the take-off nip rolls 66*a* and 66*b* is made lower than that of the embossing roll 64*a* and the backing roll 64*b*. When completed embossing treatment, the webs 61 and 62 are bonded together to form a single web 65, and a laminated web 67 which has been taken up may be optionally subjected further to bulking operation by means of the undermentioned through-air or the like means.

The backing roll 64*b* may be either a metallic roll of a flat surface or a rigid rubber roll. In this respect, when another embossing roll is employed in place of the backing roll, a more bulky web may also be obtained.

Examples of embossing patterns for shaping are shown in FIGS. 10 (A), (B), (C), and (D), respectively.

In the case when the bulky stretched filament web according to the present invention is manufactured by means of the thermal embossing bonding manner illustrated in FIG. 9, for example, a low shrinkable web prepared by heat-treating a longitudinally stretched web composed of a single polymers is employed as the longitudinally stretched web 61, while a shrinkable web prepared from a longitudinally stretched web composed of copolymers without accompanying heat-treatment is utilized as the transversely stretched web 62. When these webs are subjected to embossing treatment, filaments of the shrinkable web 62 are shrunk by the heat of the embossing rolls, while the low shrinkable web 61 is not shrunk, but bent, and as a result, a bulkiness of the united web 65 increases.

In this case, if the shrinkable web 62 has rubber elasticity, a more set of nip rolls (not shown) is disposed before the web 62 comes to be in contact with the nip rolls 63*a* and 63*b*, and the web 62 is longitudinally stretched between the more set of the nip rolls and the nip rolls 63*a* and 63*b*, whereby a bulkiness of the web 65 can be further increased.

Figure 11:
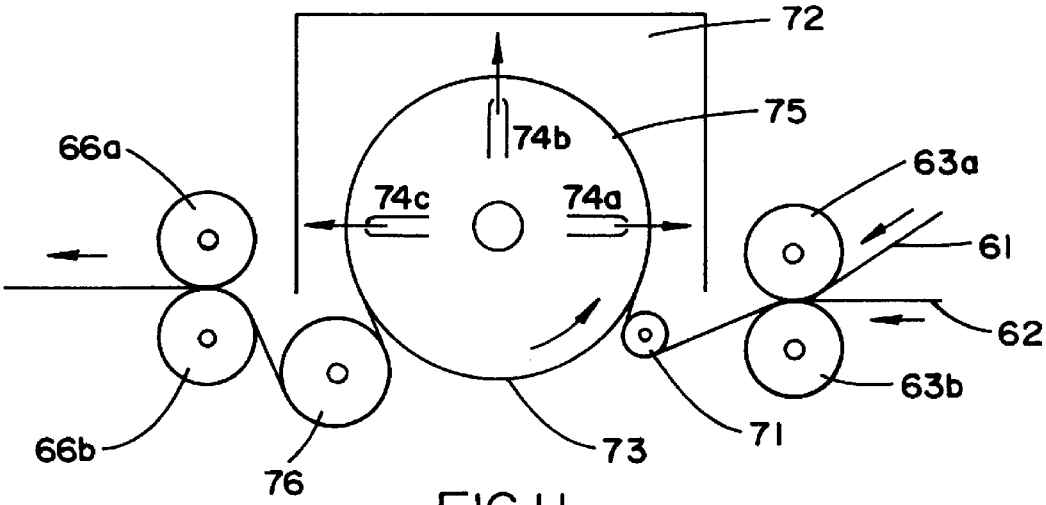
FIG. 11 is a schematic side view illustrating an example of a through-air bonding machine.

FIG. 11 is a schematic side view illustrating an example of a through-air bonding apparatus wherein at least one of the longitudinally stretched web 61 and the transversely stretched web 62 is a web comprising an adherent polymer, both the webs are taken up by the nip rolls 63*a* and 63*b*, and are introduced into a hot air chamber 72 through a turning roll 71. In the hot air chamber 72, a cage roll 73 the surface of which is covered with a metal net rotates, and hot air passes through a laminated web 75 from the inside of the cage roll via a hot air nozzles 74*a*, 74*b*, and 74*c*, respectively. The web left from the cage roll 73 in the hot air chamber 72 is taken up by the nip rolls 66*a* and 66*b* through a cooling roll 76. In also this case, when the web is subjected to bulking operation, it is preferred that a peripheral speed of the cooling roll 76 as well as that of the nip rolls 66*a* and 66*b* are lower than that of the cage roll 73.

Figure 12A:
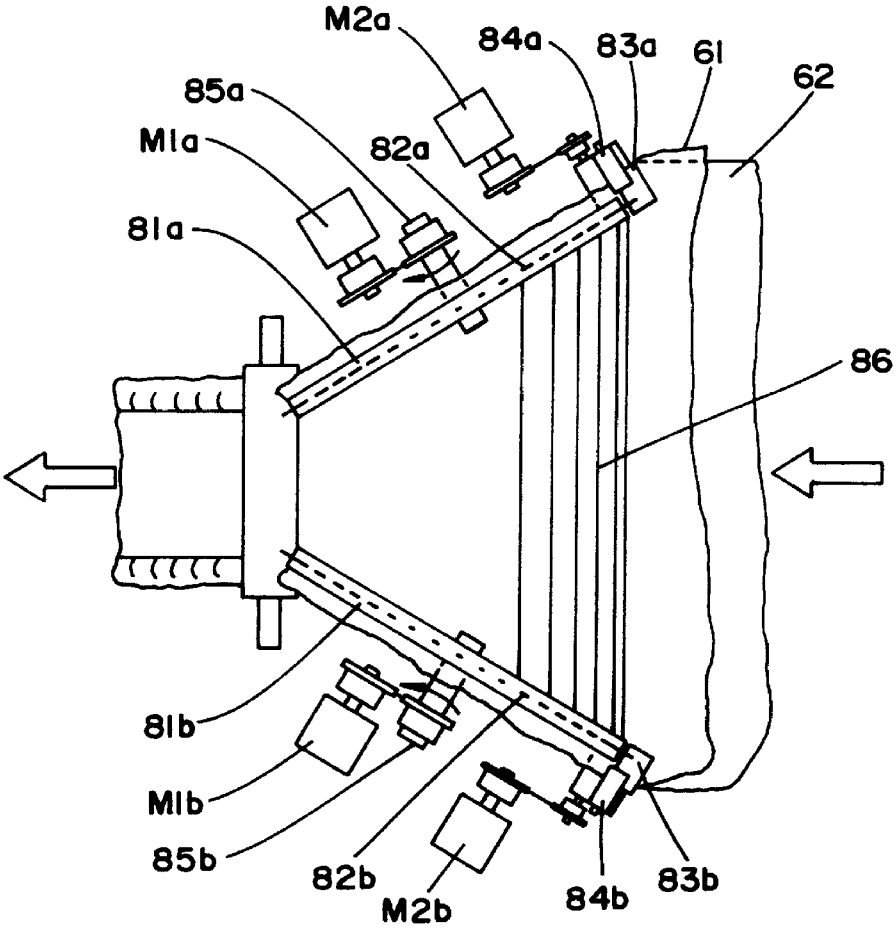
FIG. 12 (A) is a plan view showing an apparatus in which a longitudinally and transversely shrinking operation is carried out simultaneously with a through-air bonding operation.
Figure 12B:
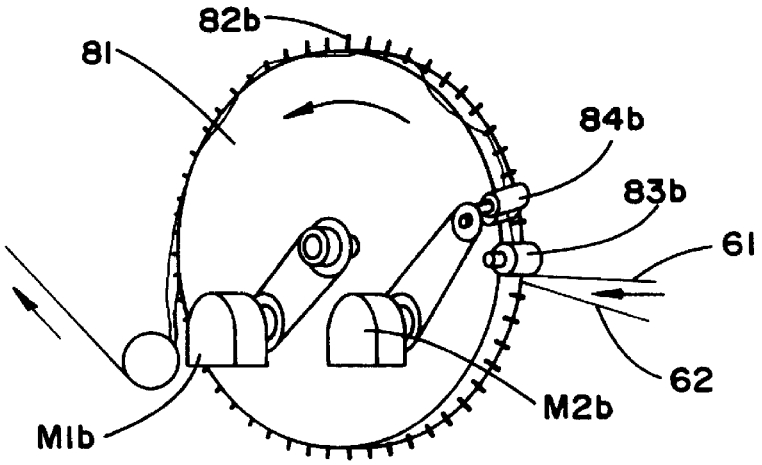
Figure 13A:
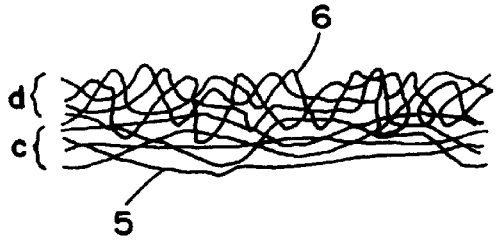
FIGS. 13 (A) to (D) are partial enlarged sectional views, each showing schematically a bulky stretched filament nonwoven fabric.
Figure 13B:
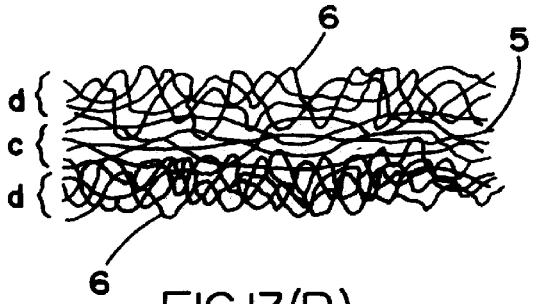
Figure 13C:
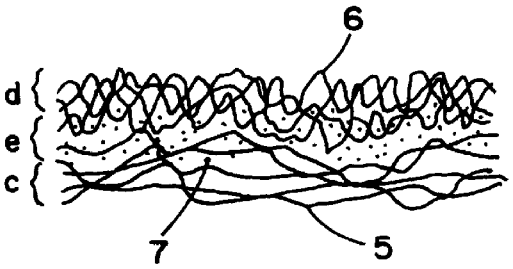
Figure 13D:
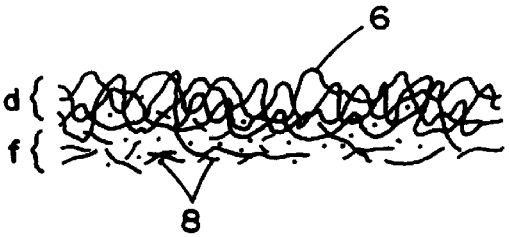

To effect bulking operation while bonding a longitudinally stretched web, a transversely stretched web and the like with each other by means of through-air, it is preferred that the laminated webs are shrunk in both the longitudinal and transverse directions. FIG. 12 (A) and (B) illustrate an example of an apparatus for passing hot air through webs while shrinking the webs in both the longitudinal and transverse directions wherein FIG. 12 (A) is a plan view of the apparatus, and FIG. 12 (B) is a side view of the apparatus.

In FIG. 12 (A), a pair of rotating discs 81*a* and 81*b* are opposed in such that a spacing defined by these discs becomes narrower along the advance direction of the webs, and these rotating discs 81*a* and 81*b* are driven by motors M1*a* and M1*b* via rotating shafts 85*a* and 85*b*, respectively. A number of pins 82*a* and 82*b* are planted on the circumferences of both the discs, respectively. The longitudinally stretched web 61 and the transversely stretched web 62 are pierced with the pins 82*a* and 82*b* on the rotating discs to be held thereon. Immediately after piercing the webs 61 and 62, the outer opposite edge portions thereof than that held with pins are further held by the nip rolls 84*a* and 84*b*. These nip rolls 84*a* and 84*b* are driven by motors M2*a* and M2*b*, respectively. When it is arranged in such that feed rates of the webs on the nip rolls 84*a* and 84*b* are higher than peripheral speeds of the rotating discs 81*a* and 81*b*, respectively, a laminated web 86 formed between both the rotating discs comes to be in a folded state along the longitudinal direction. Both the discs 81*a* and 81*b* are rotated in such that the spacing defined between them becomes narrower with the advance of the webs as described above, so that when hot air is jetted from a gap defined between them (not shown) to keep the air existing in a space enclosed by the discs and the webs at a high temperature, both the webs are shrunk in longitudinally and transversely as well as they are joined together.

As a manner for shrinking these webs, the one wherein a commercially available pin tenter is utilized is also applicable, but the apparatus illustrated in FIG. 12 is simple, besides it is superior to the former manner in that webs can be simultaneously shrunk in both the longitudinal and transverse directions. Another example of a simple apparatus for shrinking simultaneously webs along the longitudinal and transverse directions is disclosed in the above described Japanese Patent Laid-Open Publication No. Hei 6-57620 by the present inventors.

FIGS. 13 (A) to (D) are partially enlarged sectional views each showing typically the bulky stretched filament nonwoven fabric according to the present invention wherein FIG. 13 (A) illustrates the case where aligned directions of filaments of a web c and a web d are fundamentally identical, and the web c and the web d are piled up in the thick direction thereof. Filaments 5 of the web c are the ones for forming stretched filament webs constituting a stretched nonwoven fabric, and they have been shrunk after laminating and bonding the same so that these filaments are comparatively rigid. On one hand, filaments 6 of the web d are not so shrunk in the case when the filaments 5 of the web c are shrunk, so that the former filaments 6 are crimped to take a form involving partially a number of bent portions.

FIG. 13 (B) is similar to that of FIG. 13 (A) wherein the web d, the web c, and the web d are laid in three layers in the thick direction thereof. In this case, since the web c is the one which has been shrunk, it exhibit generally a low softening point so that a role for increasing adhesiveness can be expected by this web.

FIG. 13 (C) illustrates the case where onto the webs the aligned directions of which are shown in FIG. 13 (A) is laminated a web e having the other aligned direction, besides the aligned direction of filaments of the web e is cross-laminated with that of filaments of the web c and the web d, respectively. For instance, this corresponds to the case where the web c and the web d are longitudinally stretched filament webs, while the web e is a transversely stretched filament web. The reason of indication wherein the filaments 7 of the web e are represented by dots is in that the aligned directions of the filaments are vertical with respect to the plane of the stretching.

FIG. 13 (D) illustrates the case where a web f and the web d shown in FIG. 13 (A) are laminated, and the web f is a shrunk biaxially stretched filament web. The reason of indication wherein filaments 8 of the web f are represented by dots and short lines is in that aligned directions of the filaments in a biaxially stretched web are random in the plane.

Contrary to the case of FIG. 13 (D), crimped filaments may also be formed by a biaxially stretched filament web.

Furthermore, the case in which a short fiber nonwoven fabric or a conventional random nonwoven fabric is employed as the web f may also be illustrated by a similar figure to FIG. 13 (D).

In the above described example, for instance, the filaments 5 belonging usually to the own web c, but a part of them is also incorporated with the other web d. Particularly, bent filaments, e.g., the filaments 6 of the web d are incorporated with the other webs c, e, f and the like at a high ratio.

Figure 14:
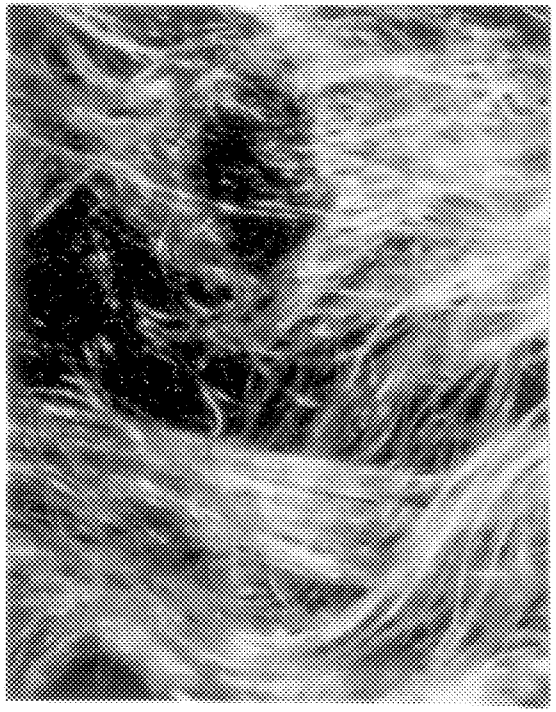
FIG. 14 is a microphotograph showing an example of a bulky stretched filament nonwoven fabric.

FIG. 14 is a microphotograph (magnification: X 20) showing an example of the bulky stretched filament nonwoven fabric according to the present invention.

The photograph shows an example of the stretched nonwoven fabric prepared from polypropylene (the undermentioned Table 7, Example X-1) wherein crimped filament groups are observed on the surface, and behind them, filament groups which are not substantially crimped can be observed. At the central portion, partly molten portions as a result of embossing bonding can also be observed.

Although an example wherein crimped filaments assemble is shown, the stretched nonwoven fabric can be made into dispersed filaments by brushing or fiber opening.

Figure 15:
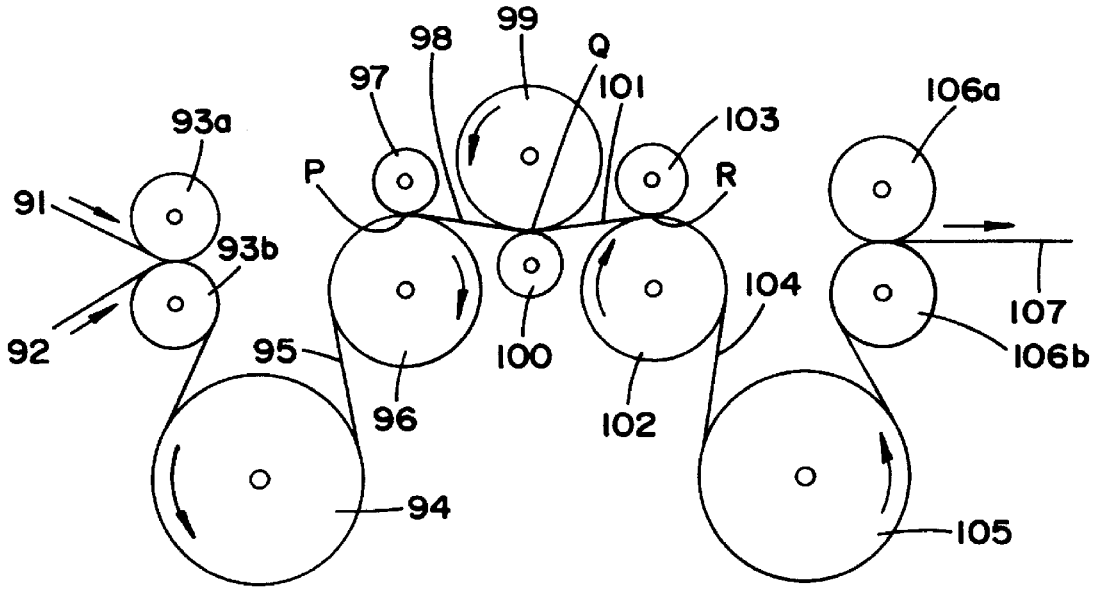
FIG. 15 is a schematic side view illustrating an example of a method for manufacturing a bulky stretched filament nonwoven fabric (Method A).

FIG. 15 is a schematic side view illustrating an example of the above method A in the method of manufacturing a bulky stretched filament nonwoven fabric according to the present invention wherein webs 91 and 92 each of which is the one composed of un-oriented long filaments having different shrinkability after stretching the same. Both the webs are introduced into a stretching device by means of nip rolls 93*a* and 93*b*, preheated with a preheating roll 94, and then guided to a stretching roll 96 in the form of a web 95. To the stretching roll 96 is mounted a rubber nip roll 97, and longitudinal stretching operation is carried out between the stretching roll 96 and a stretching roll 99. Stretching distance corresponds to a traveling distance PQ determined by a nip point P which is defined by the stretching roll 96 and the nip roll 97 and another nip point Q which is defined by the stretching roll 99 and a nip roll 100 therefor, and a web 98 is subjected to single-step stretching in the stretching distance thus determined.

In the case of requiring double-step stretching, a web is further stretched between the stretching roll 99 and a stretching roll 102. The stretching distance in this case corresponds to a traveling distance QR of a web 101 determined by the point Q and a nip point R which is defined by the stretching roll 102 and a nip roll 103.

In the case of method A, although heat treatment is not usually required, if heat treatment is necessary in longitudinal stretching operation, a web 104 may also be heat-treated by a heat-treating roll 105.

The stretched web 104 is taken up by nip rolls 106*a* and 106*b* to form a web 107 of laminated and stretched webs of different kinds.

In the method A, the web may be further bonded by means of thermal embossing, water jetting or the like manner, if required, and thereafter the bonded web is subjected to shrinking treatment, whereby a bulky stretched filament nonwoven fabric is obtained.

In the above described longitudinal stretching for a web, proximate stretching operation is suitable. If a stretching distance is too long, such filaments having the length exceeding the stretching distance are few in all the filaments constitute the web, so that a ratio of filaments to be stretched reduces. Thus, a most of the filaments are not stretched, so that spacings between filaments increase, and it results only in decrease in a thickness of the web.

Accordingly, an apparatus by which a shorter stretching distance can realize as much as possible is suitable for longitudinal stretching of a web. When the nip rolls 97, 100, and 103 are mounted to the stretching rolls shown in FIG. 15, respectively, the starting points of stretching are fixed so that stretching operations become stable, and as a result a web can be stretched at a higher ratio. For instance, if there is no nip roll 97, the stretching starting point shifts to the side of the preheating roll 94 from the point P so that the stretching distance increases, besides since the stretching starting point moves, it brings about a cause for breakage in stretching.

A web suitable for longitudinal stretching is the one wherein filaments are aligned longitudinally as much as possible from the reason mentioned above. In other words, since the filaments are aligned along the stretching direction in such web as described above, a ratio of filaments both the ends of which are held between nip points increases, besides a strength of the web after stretching is elevated.

BEST MODE FOR EXEMPLIFYING THE INVENTION

The invention will be described in more detail with reference to examples.

The types of resins used in the examples are shown in Table 1.

Testing methods for a sample are as follows:

<Strength and Elongation of Web>

With respect to a web, only the strength and elongation in the stretching direction are measured.

Filaments are sampled from a web in such a manner that the sample exhibits about 1000 denier in the stretching direction, and then the filaments are twisted about 100 times per meter. Thereafter, a strength and an elongation are measured while maintaining the twisted state of the filaments. The reason of twisting filaments is in that there is a case where a strength in a web which has been stretched without accompanying any other treatment does not correspond to a mean value of strength in actual filaments, because the web described above has poor cohesion in the filaments.

The measuring conditions are such that a chuck distance is 100 mm, and a stretching speed is 100 mm/min.

<Shrinkage Factor of Web>

A web derived from polypropylene-base resin is allowed to stand in hot air at 130° C. for 3 minutes, while a web derived from polyethylene terephthalate-base resin is allowed to stand in hot air at 190° C. for 3 minutes, respectively, and then a heat shrinkage factor in each web is measured.

<Strength and Elongation of Nonwoven Fabric>

A sample having 30 mm width and 100 mm chuck distance is prepared from a nonwoven fabric, and the sample is measured at a stretching speed of 100 mm/min.

Strength is indicated by a value (g/d) which is obtained by dividing the measured value with the denier number of a sample of nonwoven fabric. While strength may be indicated by the force per a certain width (e.g., 30 mm width) or per a unit area (e.g., $mm^2$), these manners are not suitable for the case where samples having extremely different basis weights, thickness, bulkiness and the like are compared with each other.

<Adhesive Strength>

Adhesive strength is bonding power between longitudinal webs and transverse webs. It is, however, difficult to express such adhesive strength in a unitary manner, because a variety of factors are involved in the case where types of web, manners for bonding, bulkiness are quite different from one another in webs. For the simplicity, such strength is represented herein by the one in a crosswise laminated web along a direction at 45 degrees. More specifically, a sample having 100 mm chuck distance and 50 mm width is cut out in the direction at 45 degrees, and measured at a stretching speed of 100 mm/min.

<Biaxial Work of Rupture>

Biaxial work of rupture is defined in accordance with the following equation as described hereinbefore, and the value of biaxial work of rupture is utilized as a criterion for breaking energy of a fabric.

Biaxial Work of Rupture=
Work of Rupture in Longitudinal Direction
+Work of Rupture in Transverse Direction The longitudinal work of rupture is defined herein as follows. Strength (g/d) and elongation $(L-L_0)/L_0$, wherein L is a length at breakage, and $L_0$ is an initial length, of a bonded web after laminating the same are determined in the longitudinal direction, and a value of strength X elongation/2 is considered to be the longitudinal work of rupture. Transverse work of rupture may be determined by the same manner as that described above in the determination of longitudinal work of rupture. In this respect, although a manner represented by the area of a strength-elongation curve must be essentially used, the above described manner has been adopted herein for avoiding complication. In the case of the web stretched as in the present invention, even if samples are compared with each other by using a product of strength and elongation as described above, no difference is observed in their tendencies.

<Bulk Density>

Bulk density is determined by employing a thickness gage having a cross-sectional area of 1 $cm^2$ to measure the thickness (cm) of a sample under a constant load (300 $g/cm^2$), and is represented using the basis weight (g/cm2) in accordance with the following equation.

Bulk Density (g/cc)=Basis Weight/Thickness

<Experimental Examples I-1 to 6, II-1 to 4>

Two types of resins (referred to as "Resin 1" and "Resin 2") were selected from those listed up in Table 1 and they were spun to obtain filaments, which were stretched to prepare webs. Characteristic features in the manufacturing process as well as the properties of webs are shown in the following Table 2.

Each of the webs in Table 2 can be used singly for practical uses as the nonwoven fabric of the present invention. In this case, however, it is required in most cases that processing such as embossing operation and emulsion bonding operation is applied to the resulting webs in order to integrally joining them.

<Experimental Examples III-1 to 3, IV-1 to 3>

From the resins shown in Table 1, only one principal polymer was used to conduct spinning, and the resultant filaments were stretched to obtain webs. Characteristic features in the manufacturing process as well as the properties of webs are shown in Table 3.

TABLE 1

| Symbol | Component | MFR(1) (g/10 min) | [η](2) (dl/g) | Remark |
|---|---|---|---|---|
| PP-1 | Polypropylene (single) | 152 | — | |
| PP-2 | Polypropylene (single) | 250 | — | |
| PP-3 | Polypropylene (single) | 300 | — | |
| PP-4 | Propylene-ethylene random copolymer | 300 | — | Ethylene content: 2 wt % |
| Adhesive PP | Maleic modified polypropylene | 530 | — | Maleic modification: 0.15 wt % |
| PET-1 | Polyethylene terephthalate | — | 0.73 | Trademark: NEH 2031 made by Unitika Ltd. |
| PET-2 | Polyethylene terephthalate | — | 0.53 | Trademark: MA 2100 made by Unitika Ltd. |
| Modified PET-1 | — | — | — | Trademark: ERIEL 3800 made by Unitika Ltd. |
| Modified PET-2 | — | — | 0.65 | Trademark: DIANITE made by |

TABLE 1-continued

| Symbol | Component | MFR(1) (g/10 min) | [η](2) (dl/g) | Remark |
|---|---|---|---|---|
| | | | | Mitsubishi Rayon Co., Ltd. |
| HDPE | High density polyethylene | 80 | — | |
| LLDPE | Straight chain low density polyethylene | 100 | — | |

Notes:
(1): Melt flow rate (JIS K 6758)
(2): Intrinsic viscosity

TABLE 2-1

| Exp. Example | I-1 | I-2 | I-3 | I-4 |
|---|---|---|---|---|
| Resin 1 | | | | |
| Kind | PP-1 | PP-2 | PET-1 | PET-1 |
| Content (wt %) | 75 | 80 | 60 | 60 |
| Resin 2 | | | | |
| Kind | PP-4 | Adhesive PP | PET-2 | PET-2 |
| Content (wt %) | 25 | 20 | 40 | 40 |
| Spinning | | | | |
| Form of filament | Conjugate FIG. 1 (B) | Mixed | Conjugate FIG. 1 (D) | Mixed |
| Apparatus | Spunbonding FIGS. 3 & 4 (A) | Spunbonding FIGS. 3 & 4 (B) | Melt-blow FIGS. 5 & 6 | Spunbonding FIGS. 3 & 4 (B) |
| Stretching | | | | |
| Apparatus | Proximate roll 1 step longi. stretching | Proximate roll 1 step longi. stretching | Proximate roll 2 step long. stretching | Proximate roll 2 step long. stretching |
| Ratio | 8.5 | 8.0 | 7.2 | 7.0 |
| Web Properties | | | | |
| Denier, Av. | 0.3 | 0.7 | 0.1 | 2.1 |
| Direction of alignment | longi. | longi. | longi. | longi. |
| Basis weight (g/m$^2$) | 8 | 12 | 7 | 18 |
| Strength (g/d) | 3.2 | 3.0 | 2.8 | 2.2 |
| Extension (%) | 15 | 17 | 11 | 14 |

Note
longi. means longitudinal;
trans. means transversal

TABLE 2-2

| Exp. Example | I-5 | I-6 | II-1 |
|---|---|---|---|
| Resin 1 | | | |
| Kind | PET-1 | HDPE | PET-1 |
| Content (wt %) | 70 | 80 | 50 |
| Resin 2 | | | |
| Kind | Modified PET | LLDPE | PP-1 |
| Content (wt %) | 30 | 20 | 50 |
| Spinning | | | |
| Form of filament | Conjugate FIG. 1 (C) | Conjugate FIG. 1 (A) | Conjugate FIG. 1 (H) |
| Apparatus | Spunbonding FIGS. 3 & 4 (A) | Spunbonding FIGS. 3 & 4 (B) | Unidirectional aligning FIGS. 7 & 8 |
| Stretching | | | |
| Apparatus | Proximate roll 2 step longi. stretching | Proximate roll 2 step longi. stretching | Pulley method 2 step trans. stretching |

TABLE 2-2-continued

| Exp. Example | I-5 | I-6 | II-1 |
|---|---|---|---|
| Ratio | 6.5 | 8.5 | 7.5 |
| Web Properties | | | |
| Denier, Av. | 0.8 | 0.7 | 0.2 |
| Direction of alignment | longi. | longi. | trans. |
| Basis weight (g/m$^2$) | 5 | 12 | 17 |
| Strength (g/d) | 2.0 | 3.0 | 2.9 |
| Extension (%) | 10 | 17 | 15 |

TABLE 2-3

| Exp. Example | II-2 | II-3 | II-4 |
|---|---|---|---|
| Resin 1 | | | |
| Kind | PET-1 | PP-1 | PET-1 |
| Content (wt %) | 85 | 50 | 60 |
| Resin 2 | | | |
| Kind | Modified PET-1 | PP-4 | PET-2 |
| Content (wt %) | 15 | 50 | 40 |
| Spinning | | | |
| Form of filament | Mixed | Conjugate FIG. 1 (G) | Mixed |
| Apparatus | Unidirectional aligning FIGS. 7 & 8 | Unidirectional aligning FIGS. 7 & 8 | Air aligning |
| Stretching | | | |
| Apparatus | Pulley method 2 step trans. | Pulley method 2 step trans. | Grooved roll 4 step trans. |

TABLE 2-3-continued

| Exp. Example | II-2 | II-3 | II-4 |
|---|---|---|---|
| | stretching | stretching | stretching |
| Ratio | 7.0 | 7.5 | 6.1 |
| Web Properties | | | |
| Denier, Av. | 0.1 | 0.2 | 1.2 |
| Direction of alignment | trans. | trans. | trans. |
| Basis weight (g/m$^2$) | 8 | 20 | 28 |
| Strength (g/d) | 2.5 | 2.9 | 2.1 |
| Extension (%) | 14 | 15 | 38 |

TABLE 3-1

| Exp. Example | III-1 | III-2 | III-3 |
|---|---|---|---|
| Kind of Resin | PP-1 | PP-4 | PET-1 |
| Spinning Method and Apparatus | Spunbonding FIGS. 3 & 4 (A) | Melt-blow FIGS. 5 & 6 | Melt-blow FIGS. 5 & 6 |
| Stretching | | | |
| Apparatus | Proximate roll 2 step longi. stretching | Proximate roll 1 step longi. stretching | Proximate roll 2 step longi. stretching |
| Ratio | 9.2 | 8.5 | 7.2 |
| Web Properties | | | |
| Denier, Av. | 0.3 | 0.5 | 0.1 |
| Direction of alignment | longi. | longi. | longi. |
| Basis weight (g/m$^2$) | 8 | 5 | 3 |
| Strength (g/d) | 4.2 | 2.8 | 3.8 |
| Extension (%) | 16 | 18 | 14 |

TABLE 3-2

| Exp. Example | IV-1 | IV-2 | IV-3 |
|---|---|---|---|
| Kind of Resin | PET-2 | PP-3 | PP-1 |
| Spinning Method and Apparatus | Unidirectional aligning FIGS. 7 & 8 | Unidirectional aligning FIGS. 7 & 8 | Air aligning |
| Stretching | | | |
| Apparatus | Pulley method 2 step trans. stretching | Pulley method 2 step trans. stretching | Grooved roll 4 step trans. stretching |
| Ratio | 7.5 | 10.7 | 6.8 |
| Web Properties | | | |
| Denier, Av. | 0.2 | 0.4 | 0.7 |
| Direction of alignment | trans. | trans. | trans. |
| Basis weight (g/m$^2$) | 5 | 7 | 20 |
| Strength (g/d) | 3.7 | 4.8 | 2.5 |
| Extension (%) | 12 | 14 | 29 |

<Examples V-1 to 8>

The webs indicated in Tables 2 and 3 were employed, and they were crosswise laminated and joined together to prepare nonwoven fabrics. Characteristic features in the manufacturing process as well as the properties of the nonwoven fabrics are shown in Table 4.

<Comparative Examples VI-1, 2, VII-1 to 4>

For comparison, physical properties of filament crosswise laminated nonwoven fabrics in which different type polymers are not employed according to a conventional method (Japanese Patent Publication No. Hei 3-36948, spunbonded nonwoven fabrics, melt-blown nonwoven fabrics and flush-spun nonwoven fabrics which are nonwoven fabrics of a filament spun type according to a conventional method as well as those of a typical woven fabric for industrial uses are shown in Table 5.

Although a comparatively thick nonwoven fabric having a basis weight of 52 g/m$^2$ was used as a commercially available nonwoven fabric according to a conventional method, this is because that the values of basis weights of thin nonwoven fabrics varies widely, so that it is not suitable as comparative data.

<Experimental Examples VIII-1 to 4, IX-1 to 4>

One of the polymers shown in Table 1 was selected to conduct spinning, and the resulting filaments were stretched and heat-treated to obtain a stretched filament web which is used for manufacturing a bulky stretched filament nonwoven fabric. Characteristic features in the manufacturing process as well as properties of the web are shown in Table 6.

It is to be noted that detailed manufacturing methods for the webs in the Table are described in Japanese Patent Publication No. Hei 3-36948 proposed by the inventors of the present application.

<Example X-1, XI-1 to 7>

Laminating, bonding, and shrinking operations were carried out by employing the stretched filament webs shown in Table 6 and the other nonwoven fabrics to obtain bulky stretched filament nonwoven fabrics. Characteristic features in the manufacturing process as well as the properties of the webs are shown in Table 7.

TABLE 4-1

| Example | V-1 | V-2 | V-3 | V-4 |
|---|---|---|---|---|
| Kind of Longitudinal Web (‖) | I-1 | I-2 | I-3 | I-4 |
| Kind of Transverse Web (⊥) | IV-2 | IV-2 | II-2 | II-1 |
| Structure of Web | ‖ - ⊥ - ‖ | ‖ - ⊥ | ‖ - ⊥ | ‖ - ⊥ |
| Cross-Lamination | | | | |
| Lamination[1] Adhesion | Method 1 Through Air | Method 1 Heat Embossing | Method 1 Ultrasonic/ Through Air | Method 1 Water Jet/ Through Air |
| Properties of Nonwoven Fabric | | | | |
| Basis weight (g/m$^2$) | 29 | 27 | 24 | 56 |
| Strength (g/d) | | | | |
| Longitudinal | 1.4 | 1.3 | 0.9 | 0.8 |
| Transverse | 0.8 | 1.1 | 0.9 | 0.6 |
| Extension (%) | | | | |
| Longitudinal | 48 | 39 | 57 | 38 |
| Transverse | 31 | 28 | 42 | 39 |
| Work of Biaxial Rupture (g/d) | 0.46 | 0.41 | 0.45 | 0.27 |
| Adhesive Strength (g/d) | 0.6 | 0.8 | 0.6 | 0.5 |
| Bulk Density (g/cc) | 0.04 | 0.06 | 0.02 | 0.04 |

Note

[1]: In Method 1 of Lamination, longitudinally stretched web and transversely stretched web were laminated. In Method 2, longitudinally stretched webs were laminated with a cross-laminating machine.

TABLE 4-2

| Example | V-5 | V-6 | V-7 | V-8 |
|---|---|---|---|---|
| Kind of | I-5 | I-6 | III-1 | III-3 |

TABLE 4-2-continued

| Example | V-5 | V-6 | V-7 | V-8 |
|---|---|---|---|---|
| Longitudinal Web (‖) | | | | |
| Kind of Transverse Web (⊥) | IV-1 | — | II-3 | II-2 |
| Structure of Web | ‖ - ⊥ - ‖ | ‖ - ‖ | ‖ - ⊥ - ‖ | ‖ - ⊥ - ‖ |
| Cross-Lamination | | | | |
| Lamination[1] | Method 1 Heat Embossing | Method 2 Through Air | Method 1 Ultrasonic/ Through Air | Method 1 Emulsion/ Through Air |
| Adhesion | | | | |
| Properties of Nonwoven Fabric | | | | |
| Basis weight ($g/m^2$) | 22 | 37 | 44 | 19 |
| Strength (g/d) | | | | |
| Longitudinal | 0.7 | 0.6 | 1.3 | 0.9 |
| Transverse | 0.7 | 0.6 | 0.9 | 0.6 |
| Extension (%) | | | | |
| Longitudinal | 46 | 37 | 31 | 28 |
| Transverse | 30 | 35 | 45 | 48 |
| Work of Biaxial Rupture (g/d) | 0.26 | 0.22 | 0.41 | 0.27 |
| Adhesive Strength (g/d) | 0.6 | 0.5 | 0.7 | 0.5 |
| Bulk Density (g/cc) | 0.05 | 0.08 | 0.04 | 0.09 |

TABLE 5-1

| Comp. Example | VI-1 | VI-2 | VII-1 |
|---|---|---|---|
| Kind of Web and Nonwoven Fabric | (‖) III-1 (⊥) IV-2 | (‖) III-3 (⊥) IV-1 | Spunbonded nonwoven fabric |
| Polymer | PP | PET | PET |
| Structure of Web and Method of Adhesion | ‖ - ⊥ Ultrasonic adhesion | ‖ - ⊥ - ‖ Emulsion adhesion | Heat embossing adhesion |
| Properties of Nonwoven Fabric | | | |
| Basis weight ($g/m^2$) | 19 | 15 | 52 |
| Strength (g/d) | | | |
| Longitudinal | 1.5 | 1.4 | 0.5 |
| Transverse | 1.2 | 1.3 | 0.1 |
| Extension (%) | | | |
| Longitudinal | 15 | 14 | 28 |
| Transverse | 14 | 12 | 25 |
| Work of Biaxial Rupture (g/d) | 0.19 | 0.17 | 0.09 |
| Adhesive Strength (g/d) | 0.8 | 0.7 | 0.2 |
| Bulk Density (g/cc) | 0.25 | 0.44 | 0.11 |

TABLE 5-2

| Comp. Example | VII-2 | VII-3 | VII-4 |
|---|---|---|---|
| Kind of Web and Nonwoven Fabric | Melt blown nonwoven fabric | Flash spinning nonwoven fabric | Woven fabric "Tarpaulin" |
| Polymer | PP | HDPE | Nylon[1] |
| Structure of Web and Method of Adhesion | — | — | longi.: 25/inch trans.: 25/inch |
| Properties of Nonwoven Fabric | | | |
| Basis weight ($g/m^2$) | 31 | 56 | 52 |
| Strength (g/d) | | | |
| Longitudinal | 0.2 | 1.4 | 3.1 |
| Transverse | 0.1 | 1.0 | 2.8 |
| Extension (%) | | | |
| Longitudinal | 15 | 15 | 25 |
| Transverse | 23 | 11 | 22 |
| Work of Biaxial Rupture (g/d) | 0.03 | 0.16 | 0.69 |
| Adhesive Strength (g/d) | 0.1 | 1.0 | — |
| Bulk Density (g/cc) | 0.06 | 0.38 | 0.16 |

Note

[1]: 210 d, multifilament

TABLE 6-1

| Exp. Example | VIII-1 | VIII-2 | VIII-3 | VIII-4 |
|---|---|---|---|---|
| Kind of Resin | PP-1 | PP-4 | PET-1 | Modified PET-1 |
| Spinning Method and Apparatus | Spunbond | Melt-blow | Melt-blow | Melt-blow |
| Stretching | | | | |

TABLE 6-1-continued

| Exp. Example | VIII-1 | VIII-2 | VIII-3 | VIII-4 |
|---|---|---|---|---|
| Apparatus | Proximate roll 2 step longi. stretching | Proximate roll 1 step longi. stetching | Proximate roll 2 step longi. stretching | Proximate roll 1 step longi. stretching |
| Temp. (°C.) | 110, 135 | 105 | 85, 115 | 85 |
| Ratio | 8.7 | 8.2 | 6.3 | 6.5 |
| Heat Treatment | | | | |
| Method | Hot air shrink | None | Hot air shrink | None |
| Temp. (°C.) | 135 | | 200 | |
| Web Properties | | | | |
| Direction of alignment | Longi. | Longi. | Longi. | Longi. |
| Basis weight (g/m$^2$) | 10 | 11 | 7 | 6 |
| Strength (g/d) | 3.5 | 3.1 | 3.6 | 3.2 |
| Extension (%) | 32 | 19 | 28 | 26 |
| Shrinkage (%) | 2.1 | 42.5 | 1.8 | 32.4 |

Notes:
Longi. = Longitudinal;
Trans. = Transverse

TABLE 6-2

| Exp. Example | IX-1 | IX-2 | IX-3 | IX-4 |
|---|---|---|---|---|
| Kind of Resin | PET-2 | Modified PET-2 | PP-1 | PP-4 |
| Spinning Method and Apparatus | Unidirectional aligning | Unidirectional aligning | Air aligning | Unidirectional aligning |
| Stretching | | | | |
| Apparatus | Pulley method 2 step trans. stretching | Pulley method 2 step trans. stretching | Grooved roll 4 step trans. stretching | Pulley method 1 step trans. stetching |
| Temp. (°C.) | 85, 110 | 85, 105 | 110 | 100 |
| Ratio | 6.4 | 6.1 | 6.3 | 8.0 |
| Heat Treatment | | | | |
| Method | Hot air shrink | None | Fixed length hot roll | None |
| Temp. (°C.) | 195 | | 135 | |
| Web Properties | | | | |
| Direction of alignment | Trans. | Trans. | Trans. | Trans. |
| Basis weight (g/m$^2$) | 8 | 7 | 15 | 10 |
| Strength (g/d) | 3.4 | 3.7 | 2.7 | 2.8 |
| Extension (%) | 25 | 15 | 39 | 21 |
| Shrinkage (%) | 2.8 | 33.2 | 3.9 | 34.6 |

TABLE 7-1

| Example | X-1 | XI-1 | XI-2 | XI-3 |
|---|---|---|---|---|
| Kind of Longitudinal Web | (1) VIII-1 (2) VIII-2 | (1) VIII-1 (2) VIII-2 | (1) VIII-3 (2) VIII-4 | (1) VIII-1 (2) VIII-2 |
| Kind of Transverse Web | — | — | — | (3) IX-3 |
| Structure of Web | (1)-(2) | (1)-(2)-(1) | (1)-(2) | (1)-(2)-(3) × 3-(2)-(1) |
| Lamination and Adhesion methods | Heat embossing (FIG. 9) | Through air (FIG. 11) | Heat embossing (FIG. 9) | Ultrasonic adhesion/Through air |
| Web Properties | | | | |
| Basis weight (g/m$^2$) | 29 | 41 | 27 | 72 |
| Strength (g/d) | | | | |
| Longi. | 1.8 | 1.9 | 1.7 | 0.8 |
| Trans. | — | — | — | 0.7 |

TABLE 7-1-continued

| Example | X-1 | XI-1 | XI-2 | XI-3 |
|---|---|---|---|---|
| Extension (%) | | | | |
| Longi. | 36 | 41 | 39 | 38 |
| Trans. | — | — | — | 12 |
| Bulk Density (g/cc) | 0.05 | 0.03 | 0.04 | 0.07 |

TABLE 7-2

| Example | X-4 | XI-5 | XI-6 | XI-7 |
|---|---|---|---|---|
| Kind of Longitudinal Web | (1) VIII-3<br>(2) VIII-4 | (1) Tow Opening<br>(2) VIII-4 | (1) PP Spunbond<br>(2) VIII-2 | (1) VIII-3<br>(2) Urethane nonwoven fab. |
| Kind of Transverse Web | (3) IX-1<br>(4) IX-2 | — | — | — |
| Structure of Web | (1)-(2)-(3)-(4)-(3)-(2)-(1) | (1)-(2)-(1) | (1)-(2)-(1) | (1)-(2)-(1) |
| Lamination and Adhesion methods | Water jet/ through air | Heat embossing (FIG. 9) | Through air (FIG. 11) | Heat embossing (FIG. 9) |
| Web Properties | | | | |
| Basis weight (g/m$^2$) | 89 | 25 | 69 | 48 |
| Strength (g/d) | | | | |
| Longi. | 0.7 | 2.3 | 0.9 | 1.1 |
| Trans. | 0.6 | — | — | — |
| Extension (%) | | | | |
| Longi. | 42 | 33 | 36 | 48 |
| Trans. | 39 | — | — | — |
| Bulk Density (g/cc) | 0.02 | 0.08 | 0.07 | 0.04 |

Example X-1 in Table 7 shows an example of the case (method A) wherein a laminating operation is conducted during a stretching step in which the web in VIII-1 and the web in VIII-2 are put in layers together in the proximate roll stretching machine shown in FIG. 15 prior to stretching, these webs thus joined are stretched longitudinally 8.2 times longer at 110° C., and crimps are produced in these webs by treating them with the embossing machine shown in FIG. 9.

Each of Examples XI-1 through XI-4 shows the case wherein stretched filament webs are laminated and shrunk (method B).

Example XI-5 shows the case wherein a web to be crimped is the web obtained by opening filament tow and expanding the width thereof.

Example XI-6 show the case wherein a web to be crimped is a commercially available spunbonded nonwoven fabric made of polypropylene (having 20 g/m$^2$ basis weight, trade name: PP SPUNBOND manufactured by Asahi Kasei Kogyo K.K.).

Example XI-7 shows the case wherein a rubber elastic nonwoven fabric (having 20 g/m2 basis weight, trade name: EXPANSIONE manufactured by Kanebo K.K.) is employed as a shrinkable web, the aforesaid web 62 is stretched four times longer along the longitudinal direction in the embossing device shown in FIG. 9 before the web comes in contact with the nip rolls 63*a* and 63*b*.

It has been found that each of the fabrics listed up in Table 7 has appropriately both the strength and bulkiness when compared with the Comparative Examples of longitudinally and transversely laminated nonwoven fabrics, spunbonded nonwoven fabrics, melt-blown nonwoven fabrics and the like according to a conventional method shown in Table 5.

INDUSTRIAL APPLICABILITY

According to the present invention, a nonwoven fabric obtained by crosswise intersecting stretched filaments prepared from different type polymers with each other to combine them exhibits equivalent mechanical properties, breakdown strength, and uniformity in basis weight to that of a woven fabric, besides the nonwoven fabric has characteristics peculiar to the present invention such as draping properties, a bulkiness, and good feeling.

The present invention is characterized in that particularly, a nonwoven fabric having a large elongation can be manufactured. Due to the high elongation value, the nonwoven fabric exhibits a high breakdown strength, besides such a product having excellent draping properties, good feeling and the like can be obtained in also practical use.

Heretofore, while there was such a tendency that a bulkiness and good feeling were damaged by employing an adhesive or the like, the present invention uses an adherent polymer as one of different type polymers, so that it became possible to manufacture a nonwoven fabric having a high bulkiness, besides being also excellent in good feeling and draping properties with accompanying an unchanged strength and elongation.

Furthermore, in accordance with the present invention, a nonwoven fabric being particularly excellent in strength and bulkiness as well as the method of manufacturing the same could have been accomplished. More specifically, the present invention does not require a complicated and expensive apparatus such as conjugate spinning machine, incorporatively spinning machine or the like which is necessary for a conventional method of manufacturing bulky nonwoven fabrics, but a simple apparatus wherein plural layers of webs having different shrinkability are combined with each other. Accordingly, the present invention requires merely inexpensive installation cost, besides the present invention is applicable to the case where the volume of production is relatively low and there are a wide variety of products to be made, and as a result it becomes possible to provide inexpensive nonwoven fabrics and the method for manufacturing the same.

We claim:

1. A nonwoven fabric comprising a first fiber web prepared by stretching a mass of long fiber filaments, said long fiber filaments formed from at least two different thermoplastic polymers wherein said filaments are aligned in one direction, and a second fiber web laminated to said first fiber web wherein said first and said second fiber webs each have a strength of at least 0.5 g/d.

2. A nonwoven fabric in accordance with claim 1 wherein said long fiber filaments of said first fiber web have a strength of at least 1.5 g/d.

3. A nonwoven fabric in accordance with claim 1 wherein said long fiber filaments of said first fiber web comprise conjugate filaments formed of at least two different thermoplastic polymers having different properties.

4. A nonwoven fabric in accordance with claim 1 wherein said long fiber filaments of said first fiber web comprise a mixture of at least a first filament of a first thermoplastic polymer and a second filament of a second thermoplastic polymer, said first and said second thermoplastic polymers having different properties.

5. A nonwoven fabric in accordance with claim 1 wherein said second fiber web is crosswise laminated to said first fiber web.

6. A nonwoven fabric in accordance with claim 5 wherein said nonwoven fabric has a biaxial work of rupture of at least 0.2 g/d and a bulkiness of no more than 0.1 g/cc.

7. A nonwoven fabric in accordance with claim 1 wherein said long fiber filaments include crimped filaments.

8. A method of making a nonwoven fabric comprising preparing a first fiber web formed of long fiber filaments, said filaments formed of at least two thermoplastic polymers having different properties and having substantially no molecular orientation; [and] stretching said first fiber web in one direction whereby a stretched first fiber web is obtained; and laminating a second fiber web to said first fiber web, wherein said first and said second fiber webs each have a strength of at least 0.5 g/d.

9. A method in accordance with claim 8 including the step of crimping said stretched first fiber web.

10. A method in accordance with claim 9 wherein said second fiber web is an aligned nonwoven fabric which is crosswise laminated to said first crimped stretched fiber web.

11. A method in accordance with claim 8 comprising crosswise laminating said stretched first fiber web with a second aligned nonwoven fabric and thereafter shrinking said first fiber web and said second aligned nonwoven fabric in at least one direction.

12. A method in accordance with claim 8 wherein said long fiber filaments are conjugate filaments formed of at least two different thermoplastic polymers having different properties.

13. A method in accordance with claim 8 wherein said long fiber filaments comprise a first filament of a first thermoplastic polymer and a second filament of a second thermoplastic polymer, said first and said second filaments having different properties.

14. A nonwoven fabric formed of long fiber filaments comprising a first fiber web, said first fiber web comprising crimped filaments, and a second fiber web, laminated to said first fiber web, comprising uncrimped stretched long fiber filaments, said filaments of said first fiber web having properties different from said filaments of said second fiber web, wherein said nonwoven fabric has a strength of at least 0.5 g/d in at least one direction and a bulk density of no more than 0.1 g/cc.

15. A method of making a nonwoven fabric comprising (a) laminating a first fiber web to a second fiber web, said first and said second fiber webs having different shrink properties, to form a laminated web;

(b) joining at least two laminated webs together to form a joined web; and (c) shrinking said joined web whereby the joined web is crimped, with the proviso that step (c) may occur simultaneously with or subsequent to step (b).

16. A method in accordance with claim 15 wherein said first and said second fiber webs comprise long fiber filaments substantially without molecular orientation with the proviso that said filaments of said first and said second fiber webs are formed of polymers having different shrink characteristics when stretched and including the step of stretching said webs in one direction.

17. A method in accordance with claim 15 wherein said first and said second fiber webs comprise long fiber filaments substantially without molecular orientation with the proviso that said filaments of said first and said second fiber webs are formed of polymers having different shrink characteristics when stretched and wherein said first and said second fiber webs are laminated such that said first and said second fiber webs are aligned in the same direction of stretching.

18. A method in accordance with claim 15 wherein at least one of said first and said second fiber webs has rubber-like elasticity in the unstretched state.

* * * * *

UNITED STATES PATENT AND TRADEMARK OFFICE

CERTIFICATE OF CORRECTION

PATENT NO. : 5,840,633
DATED : November 24, 1998
INVENTOR(S) : K. Kurihara et al.

It is certified that error appears in the above-identified patent and that said Letters Patent is hereby corrected as shown below:

Column 33,
Line 19, "orientation; [and]" should read -- orientation --

Signed and Sealed this

Eleventh Day of March, 2003

JAMES E. ROGAN
*Director of the United States Patent and Trademark Office*